US008814158B2

(12) United States Patent
Washino et al.

(10) Patent No.: US 8,814,158 B2
(45) Date of Patent: Aug. 26, 2014

(54) IMAGE RECORDING APPARATUS

(71) Applicants: Yoshiyuki Washino, Gifu-ken (JP); Yuji Koga, Nagoya (JP)

(72) Inventors: Yoshiyuki Washino, Gifu-ken (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/779,551

(22) Filed: Feb. 27, 2013

(65) Prior Publication Data

US 2013/0221598 A1 Aug. 29, 2013

(30) Foreign Application Priority Data

Feb. 29, 2012 (JP) ..... 2012-043492

(51) Int. Cl.

| | |
|---|---|
| ***B65H 5/22*** | (2006.01) |
| ***B65H 83/00*** | (2006.01) |
| ***B65H 85/00*** | (2006.01) |
| ***B65H 31/20*** | (2006.01) |
| ***B65H 31/26*** | (2006.01) |

(52) U.S. Cl.

CPC ..... *B65H 31/26* (2013.01); *B65H 2511/20* (2013.01); *B65H 2402/46* (2013.01); *B65H 2801/06* (2013.01); *B65H 31/20* (2013.01); *B65H 2511/10* (2013.01); *B65H 2405/32* (2013.01); *B65H 2405/3322* (2013.01)

USPC ..... 271/3.14; 271/171

(58) Field of Classification Search

CPC ..... G03G 15/60; B65H 31/02; B65H 3/44; B65H 1/04; B65H 1/266; B65H 2405/332; B65H 39/042; B65H 2511/12; B65H 13/03; B65H 31/20; B65H 31/00; B65H 31/34; B65H 31/36

USPC ..... 271/3.14, 9.11, 171, 223

See application file for complete search history.

(56) References Cited

U.S. PATENT DOCUMENTS

| | | | |
|---|---|---|---|
| 5,313,257 | A | 5/1994 | Kashima et al. |
| 6,053,493 | A | 4/2000 | Yokoyama et al. |

(Continued)

FOREIGN PATENT DOCUMENTS

| | | | |
|---|---|---|---|
| JP | SH061-130125 | A | 6/1986 |
| JP | H07-149452 | A | 6/1995 |

(Continued)

OTHER PUBLICATIONS

United States Patent and Trademark Office, Office Action for U.S. Appl. No. 12/361,536 (related U.S. patent application), mailed Sep. 24, 2013.

(Continued)

*Primary Examiner* — David H Bollinger
(74) *Attorney, Agent, or Firm* — Baker Botts L.L.P.

(57) ABSTRACT

An image recording apparatus, includes: an accommodation portion configured to accommodate a sheet; a supply mechanism configured to supply the sheet from the accommodation portion; a recording portion configured to record an image on the sheet supplied by the supply mechanism; and a first discharged tray arranged above the accommodation portion, and configured to support the sheet on which the image had been recorded by the recording portion. The accommodation portion includes: a body portion configured to accommodate the sheet; and a second discharged tray provided for the body portion and configured to move to a first position and to a second position in which the second discharged tray is positioned higher than the second discharged tray in the first position. The second discharged tray supports the sheet on which the image had been recorded, together with the first discharged tray in the second position.

15 Claims, 25 Drawing Sheets

(56) References Cited

U.S. PATENT DOCUMENTS

| | | | | |
|---|---|---|---|---|
| 6,287,032 | B1 | 9/2001 | Osmus et al. | |
| 8,272,637 | B2 * | 9/2012 | Asada et al. | 271/171 |
| 8,322,702 | B2 * | 12/2012 | Izuchi et al. | 271/9.11 |
| 8,474,809 | B2 * | 7/2013 | Izuchi et al. | 271/9.11 |
| 2002/0117796 | A1 | 8/2002 | Miyamoto | |
| 2006/0071399 | A1 | 4/2006 | Asada et al. | |
| 2007/0147940 | A1 | 6/2007 | Hattori | |
| 2008/0012206 | A1 | 1/2008 | Koga et al. | |
| 2008/0237977 | A1 | 10/2008 | Izuchi et al. | |
| 2009/0085279 | A1 | 4/2009 | Wakakusa et al. | |
| 2009/0194935 | A1 | 8/2009 | Wakakusa et al. | |
| 2012/0001378 | A1 | 1/2012 | Izuchi et al. | |

FOREIGN PATENT DOCUMENTS

| | | | |
|---|---|---|---|
| JP | H08-026502 | A | 1/1996 |
| JP | H11-092011 | A | 4/1999 |
| JP | H11-343036 | A | 12/1999 |
| JP | 2000-247456 | A | 9/2000 |
| JP | 2001-219621 | A | 8/2001 |
| JP | 2002-068491 | A | 3/2002 |
| JP | 2002-114434 | A | 4/2002 |
| JP | 2002-249233 | A | 9/2002 |
| JP | 2003-176039 | A | 6/2003 |
| JP | 2004-331253 | A | 11/2004 |
| JP | 2005-170626 | A | 6/2005 |
| JP | 2006-082919 | A | 3/2006 |
| JP | 2006-206319 | A | 8/2006 |
| JP | 2006-341973 | A | 12/2006 |
| JP | 2007-076751 | A | 3/2007 |
| JP | 2007-169021 | A | 7/2007 |
| JP | 2007-181933 | A | 7/2007 |
| JP | 2010-006586 | A | 1/2010 |
| JP | 2010-173832 | A | 8/2010 |
| JP | 2010-222062 | A | 10/2010 |
| JP | 2010-235270 | A | 10/2010 |

OTHER PUBLICATIONS

Chinese Patent Office; Office Action in Chinese Patent Application No. 200910009930.2, mailed Jan. 30, 2011. (partial translation).

U.S. Patent and Trademark Office; Office Action in U.S. Appl. No. 12/697,191, mailed Apr. 9, 2012.

Japan Patent Office, Notice of Reasons for Rejection for Japanese Patent Application No. 2009-020445, mailed Nov. 24, 2010.

Japan Patent Office; Notice of Reasons for Rejection in Japanese Patent Application No. 2008-021417, mailed May 12, 2010.

U.S. Patent and Trademark Office; Office Action in U.S. Appl. No. 12/361,536, mailed Mar. 23, 2011.

U.S. Patent and Trademark Office; Office Action in U.S. Appl. No. 12/361,536, mailed Oct. 5, 2011.

U.S. Patent and Trademark Office; Office Action in U.S. Appl. No. 12/361,536, mailed Jan. 23, 2012.

United States Patent and Trademark Office, Office Action for U.S. Appl. No. 12/361,536 (related U.S. patent application), mailed Apr. 3, 2013.

* cited by examiner

IMAGE RECORDING APPARATUS

CROSS REFERENCE TO RELATED APPLICATION

The present application claims priority from Japanese Patent Application No. 2012-043492, which was filed on Feb. 29, 2012, the disclosure of which is herein incorporated by reference in its entirety.

BACKGROUND OF THE INVENTION

1. Field of the Invention

The present invention relates to an image recording apparatus which records an image on a sheet supplied from an accommodation portion and in which the sheet on which the image had been recorded is kept on a tray.

2. Description of Related Art

The image recordina apparatus, such as a printer, commonly includes a sheet supply tray which accommodates a sheet such as a recording sheet, a recording portion which records an image on the sheet supplied from the sheet supply tray, and a sheet discharged tray which maintains the sheet on which the image had been recorded. The sheet discharge tray tends to be downsized in association with a downsizing of the image recording apparatus. However, when an image is recorded on a sheet which is larger than the sheet discharged tray, a part of the sheet goes over the sheet discharged tray, and the sheet may fall out of the sheet discharged tray. For such a problem, an image recording apparatus in which a stopper is provided for the sheet supply tray arranged below the sheet discharged tray, is known. An leading edge of the sheet having going over the sheet discharged tray reaches to above the sheet supply tray and comes into abutting contact with the stopper, whereby the sheet is prevented from falling out of the sheet discharged tray.

SUMMARY OF THE INVENTION

However, in a case of recording an imafze on a further larger sheet, such as an A3 size sheet which is a sheet size compliant with Japanese Industrial Standards, where a distance between the sheet discharged tray and the stopper is short, the leading edge of the sheet may go over the stopper, resulting in a fall-out of the sheet.

The present invention is carried out in the light of a problem of the aforementioned fall-out of the sheet, therefore, it is an object of the present invention to provide an image recording apparatus capable of securely keeping the sheet.

An image recording apparatus includes: an accommodation portion configured to accommodate a sheet; a supply mechanism configured to supply the sheet from the accommodation portion; a recording portion configured to record an image on the sheet supplied by the supply mechanism; and a first discharged tray which is above the accommodation portion, and is configured to support the sheet on which the image had been recorded by the recording portion, wherein the accommodation portion includes: a body portion configured to accommodate the sheet; and a second dischared tray provided for the body portion and configured to move between a first position and a second position, the second discharged tray in the second position being higher than the second discharged tray in the first position, and configured to support the sheet on which the image had been recorded, together with the first discharged tray.

An image recording apparatus includes: an accommodation portion configured to accommodate a sheet; an upper accommodation portion which is arranged above the accommodation portion and is configured to accommodate the sheet; a supply mechanism configured to supply the sheet from the accommodation portion; a recording portion configured to record an image on the sheet supplied by the supply mechanism; and a first discharged tray which is above the upper accommodation portion, and is configured to support the sheet on which the image had been recorded by the recording portion, wherein the upper accommodation portion is prohibited to slide in a discharge direction in which the sheet is discharged, and wherein the accommodation portion includes: a body portion configured to accommodate the sheet; a slide portion configured to slide relative to the body portion in the discharge direction; and a second discharged tray provided for the slide portion and configured to move between a first position and a second position, the second discharged tray in the second position being higher than the second discharged tray in the first position, and configured to support the sheet on which the image had been recorded, together with the first discharged tray.

DETAILED DESCRIPTION OF THE PREFERRED EMBODIMENTS

Embodiments according to the present invention are described in the following with appropriate reference to the figures. It is noted that the embodiments described below are only examples embodying the present invention. It should be appreciated that the embodiments are modified and varied within the subject matter of the present invention.

First Embodiment

General Structure of Multifunction Peripheral 10

Figure 1:
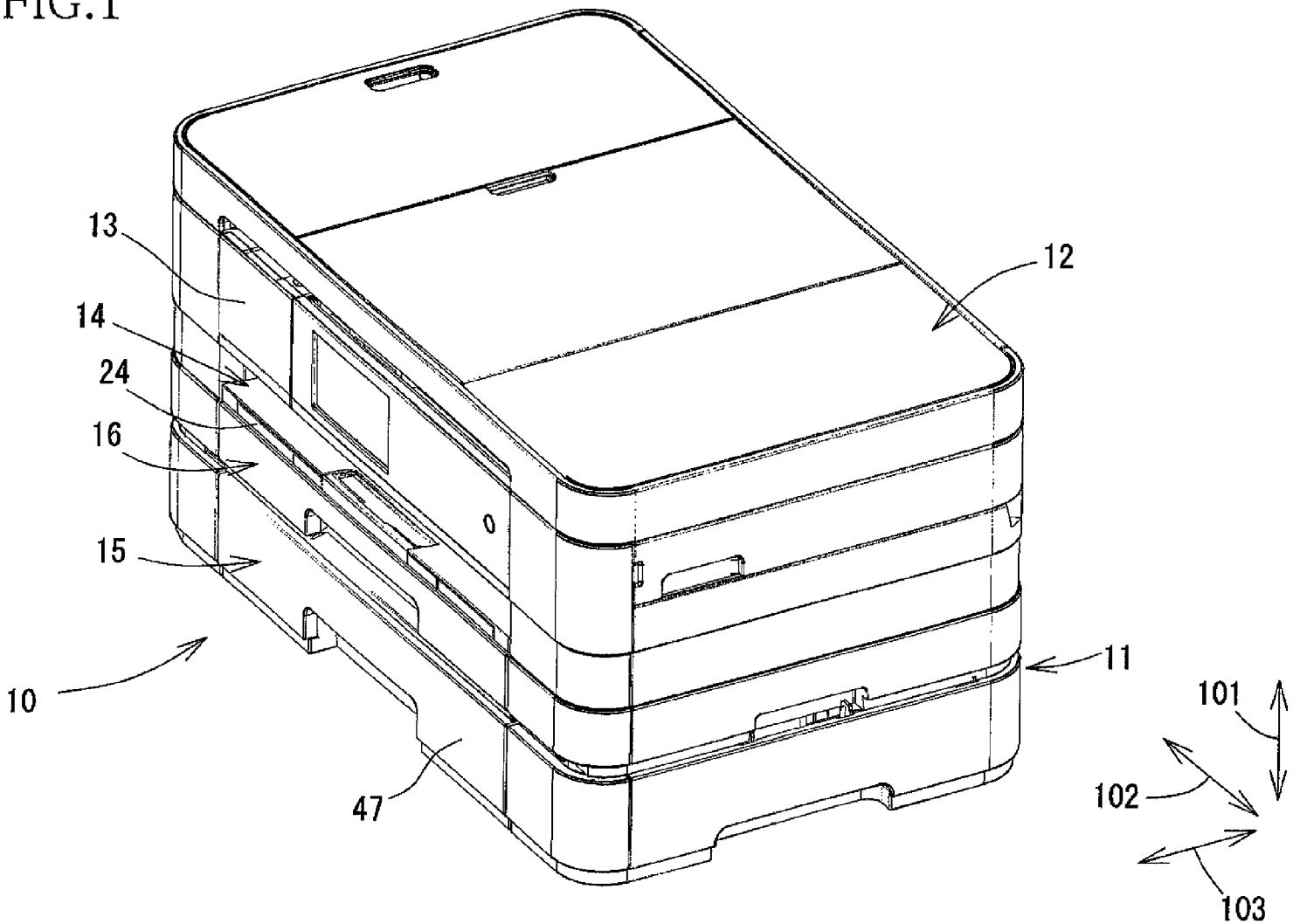
FIG. 1 shows an overview of a structure of a Multifunction Peripheral (MFP) 10 having slide trays 28, 29, as a first embodiment according to the invention.

The multifunction peripheral (MFP) 10 of the embodiment has a printer function, as well as a scanner function, a color copy function, a facsimile function, and so on. As shown in FIG. 1, the MFP 10 has an outer shape like a rectangular parallelepiped whose size is larger in a left-right direction 102 than in a front-rear direction 103, therefore the MFP 10 is wide and thin. In the MFP 10, a lower section thereof is constituted as a printer unit 11 and an upper section thereof is constituted as a scanner unit 12. Additionally, in a front face of the printer unit 11, there is provided an operation panel 13 on which various types of operation buttons for an input operation, a display portion (for example, a liquid crystal display) for displaying an image of a message etc., and the like are provided. Incidentally, a face of the MFP 10 on which the operation panel 13 is provided and which is perpendicular to the front-rear direction 103 is referred to as a front face.

Incidentally, in an image recording apparatus according to the present invention, the functions other than the printer function is optional. For example, an image recording apparatus which does not have the scanner unit 12, and has no scanner unit, no copy function, and no facsimile function, that is, an image recording apparatus having a single function may he implemented according to the present invention. Therefore, the scanner unit 12 is constituted as a so-called flatbed scanner and its detailed description is omitted herein.

A rectangular opening 14 is provided in a front face side of the printer unit 11 and in a lower side of the operation panel 13. It is possible to access to an inside space of the printer unit 11 through the opening 14. In the inside space of the printer unit 11, the first sheet supply cassette 15 and the second sheet supply cassette 16 are disposed in such an accumulated relation that the first sheet supply cassette 15 arranged below the second sheet supply cassette 16. A part of the first sheet supply cassette 15 and a part of the second sheet supply cassette 16 are exposed outwardly through the opening 14. The first sheet supply cassette 15 and the second sheet supply cassette 16 are accommodated in the inside space of the printer unit 11, and front faces of the cassettes are flush with the front face of the printer unit 11. The first sheet supply cassette 15 and the second sheet supply cassette 16 are pulled out forward in the state in which they are accommodated in the inside space of the printer unit 11, that is, pulled out of the printer unit 11 beyond the front face of the printer unit 11 one by one so as to be removed from the MFP 10. In short, the first sheet supply cassette 15 and the second sheet supply cassette 16 are detachable from the MFP 10. Incidentally, the first sheet supply cassette 15 and the second sheet supply cassette 16 may not be detached from the MFP 10 and yet may only be pulled out forward. Alternatively, the first sheet supply cassette 15 may he detached from the MFP 10 and the second sheet supply cassette 16 may not be detached from the MFP 10, or vice versa.

The first sheet supply cassette 15 and the second sheet supply cassette 16 accommodate a plurality of sheets such as recording sheets and plastic sheets in their respective inside spaces with the sheets arrayed in the left-right direction 102 and the front-rear direction 103. The first sheet supply cassette 15 is an example of an accommodation portion, and the second sheet supply cassette 16 is an example of an upper accommodation portion.

Figure 2:
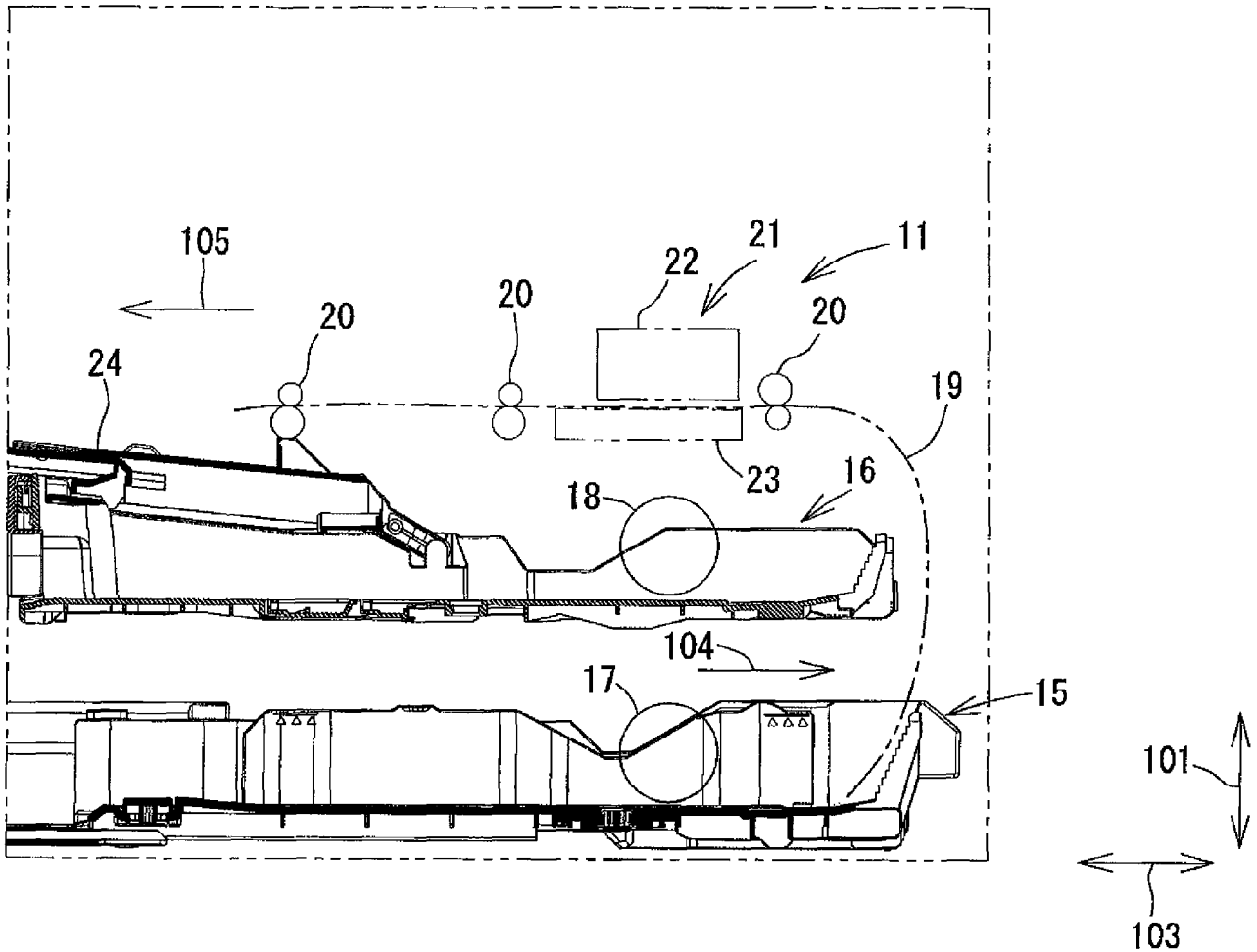
FIG. 2 is a partial cross-sectional view showing an inner structure of a printer unit 11.

As shown in FIG. 2, a first sheet supply roller 17 is provided above the first sheet supply cassette 15. Additionally, a second sheet supply roller 18 is provided above the second sheet supply cassette 16. The first sheet supply roller 17 and the second sheet supply roller 18 supply the respective sheets accommodated in the first sheet supply cassette 15 and second sheet supply cassette 16 to a conveying path 19, and are driven by respective motors not shown in the figures. Each of the first sheet supply roller 17 and the second sheet supply roller 18 comes into abutting contact with the top one of the plurality of sheets and rotates so as to supply the sheet to the conveying path 19. Additionally, not shown in the figures, the first sheet supply roller 17 and the second sheet supply roller 18 are provided at respective end portions of arms each of which is supported with its swing like a pendulum being allowed. The swing allows the arm to move close to or apart from the corresponding one of the first sheet supply cassette 15 and the second sheet supply cassette 16. The first sheet supply roller 17 and the second sheet supply roller 18 are an example of a supply mechanism.

The conveying path 19 is extended from a rear side (a right side in FIG. 2) of the first sheet supply cassette 15 to an upper side and is bent like a U-shape so as to be inverted in a front side (a left side in FIG. 2) of the printer unit 11. The sheets supplied from the first sheet supply cassette 15 and the second sheet supply cassette 16 are guided along the conveying path 19 from the rear side of the printer unit 11 to the front side of the printer unit 11 while inverted in the upper side. In the conveying path 19, a plurality of conveyor roller pairs 20 are provided. One roller of each of the conveyor roller pairs 20 is driven by a motor not shown in the figures so as to be rotated. Each of the conveyor roller pairs 20 nips the sheet passing through the conveying path 19 and rotates so as to convey the sheet from the rear side of the printer unit 11 to the front side of the printer unit 11.

In a portion of the conveying path 19 in which the conveying path 19 linearly extends front the rear side of the printer unit 11 to the front side of the printer unit 11, a recording portion 21 is provided. The recording portion 21 records an image on the sheet conveyed through the conveying path 19. The recording portion 21 is a portion which records an image on the sheet by a known technique, for example, an ink-jet technique, an electrophotographic technique, a thermal recording technique, and so on. For example, in the recording portion 21 employing the inkjet technique, a recording head 21 is disposed above the conveying path 19 and a platen 23 is disposed below the conveying path 19. The recording head 22 selectively ejects ink droplet toward the platen 23 while moving in the left-right direction 102 (a direction perpendicular to a drawing sheet of FIG. 2) relative to the sheet supported by the platen 23, and the ink droplets attach on the sheet, whereby an image is recorded on the sheet.

In an end portion of the conveying path 19, the first discharged tray 24 is provided. The sheet on which an image had been recorded by the recording portion 21 is conveyed to the conveyor roller pairs 20 and discharged front the conveying path 19. The discharged sheet will be supported by an upper portion of the first discharged tray 24. The first discharged tray 24 is constituted as an upper portion of the second sheet supply cassette 16.

First Sheet Supply Cassette 15

Figure 3:
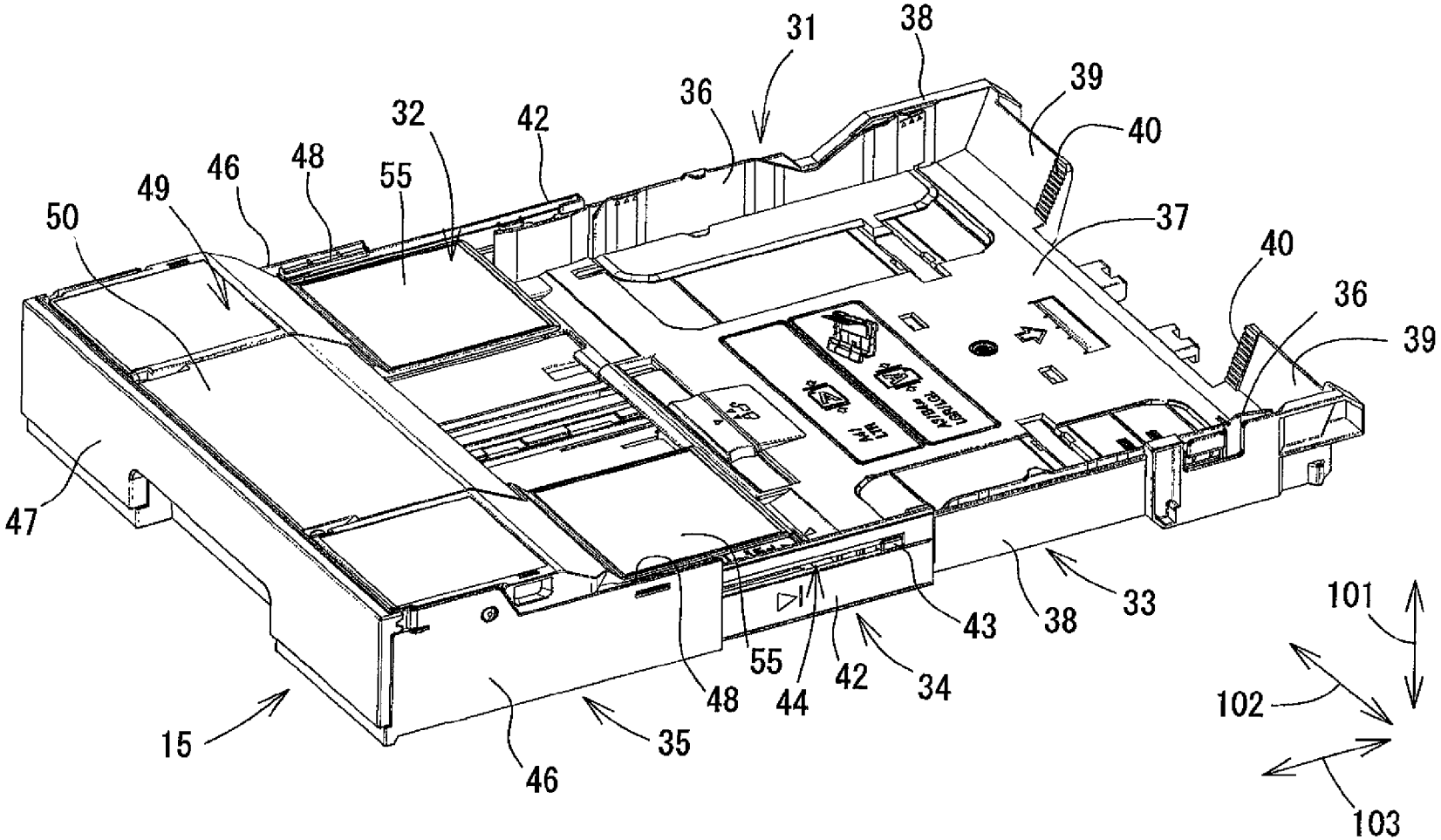
FIG. 3 is a perspective view showing an overview of a structure of a first sheet supply cassette 15 in a state in which a second discharged tray 32 is in the first posture.
Figure 4:
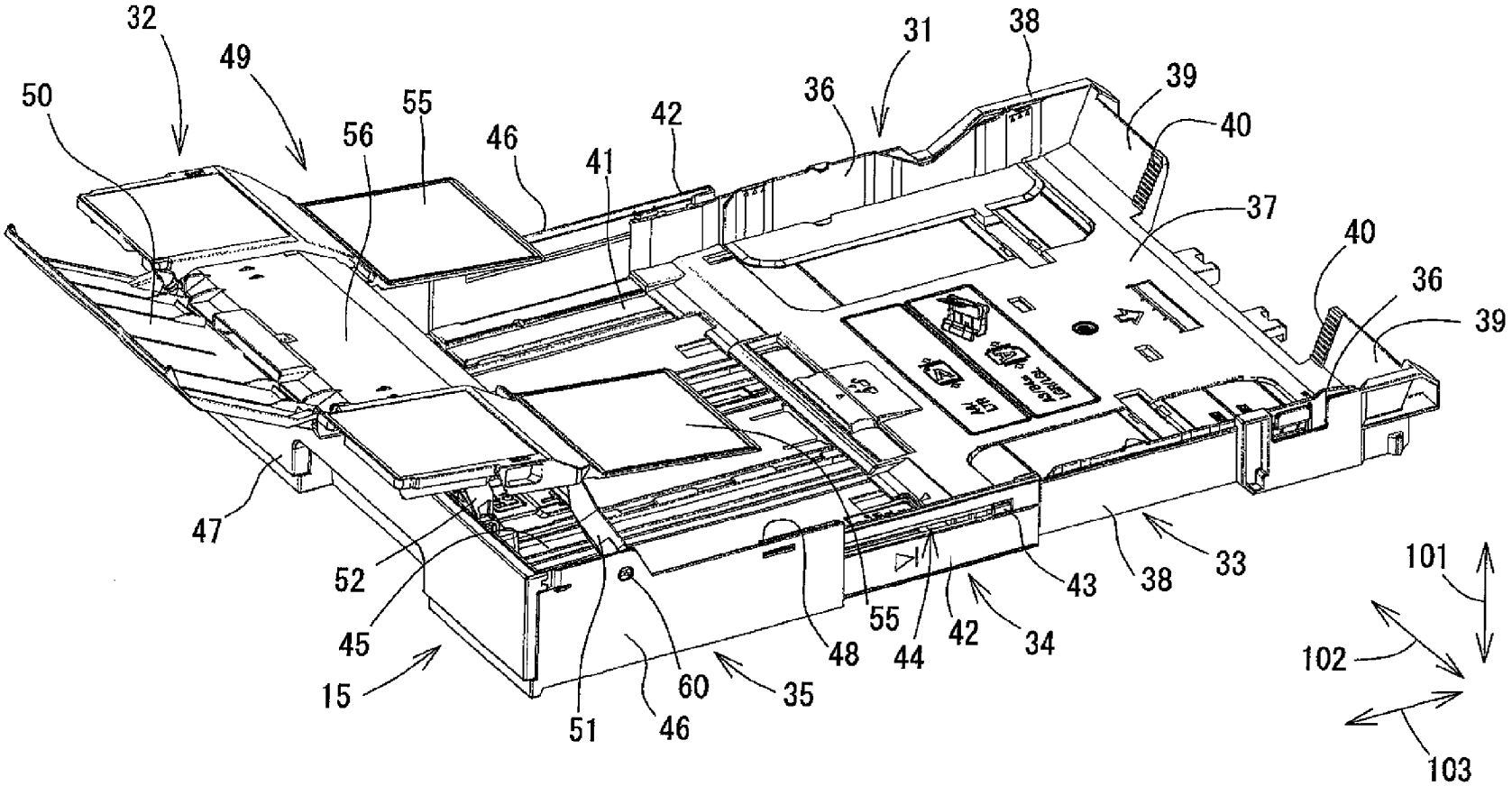
FIG. 4 is a perspective view showing the overview of the structure of the first sheet supply cassette 15 in a state in which the second discharged tray 32 is in the second posture.

As shown in FIGS. 3 and 4, the first sheet supply cassette 15 has a body portion 31 configured to accommodate the sheets, and a second discharged tray 32 provided for the body portion 31.

The body portion 31 is a plastic part like a tray showing a rectangular shape in top view and being deformable by its slide on that its size corresponds to an approximate A4 size and an approximate A3 size. That is, the body portion 31 can he deformed by its slide so as to have a size in which the sheet of the A4 size is accommodated such that a short side of the sheet of the A4 size extends in the front-rear direction 103, and so as to have a size in which the sheet of the A3 size is accommodated such that a long side of the sheet of the A3 size extends in the front-rear direction 103. The body portion 31 has a base portion 33 placed. in the rear side of the printer unit 11, a first slide portion 34 placed in the front side of the printer unit 11, a second slide portion 35 placed in front of the first slide portion 34, and side guides 36 which are provided for the base portion 33 and are movable in the left-right direction 102. FIGS. 3 and 4 show the first sheet supply cassette 15 has been deformed to the size corresponding to the A3 size.

The base portion 33 has a bottom plate 37, side walls 38 rising upward from both edges of the bottom plate 37 in the left-right direction 102, and an inclined plate 39 rising obliquely upward from a front edge of the bottom plate 37 in a sheet supplying direction 104, that is, from a rear side edge of the printer unit 11. The inclined plate 39 has a cutout in a center in the left-right direction 102. In edges positioned at both sides of the cutout in the left-right direction 102, sheet stopper portions 40 haying corrugated surfaces are provided along the sheet supplying direction 104. When the sheets are accommodated in the body portion 31, the sheets come into abutting contact, at their leading edges, with the sheet stopper portions 40, thereby preventing the sheets from going beyond the inclined plate 39 and out of the body portion 31. Not shown in the figures, an apparatus side inclined plate is provided for the rear of the printer unit 11 in the front-rear direction 103. When the first sheet supply cassette 15 is loaded in the MFP 10, the sheet stopper portion 40 goes through a through hole formed in the apparatus side inclined plate to be positioned behind the apparatus inclined plate. Therefore, the leading edges of the sheets accommodated in the body portion 31 can come into abutting contact with the apparatus side inclined plate. When the sheet placed on the bottom plate 37 is conveyed in the sheet supplying direction 104, the leading edge of the sheet comes into abutting contact with the inclined plate 39 and the apparatus side inclined plate so as to be guided obliquely upward. In the guide, the sheet is moved while the leading edge of the sheet contacts with a separating piece provided for the apparatus side inclined plate. Therefore, if the several sheets are conveyed in a layered condition, the leading edges of the layered sheets are separated by the separating piece, and only the top sheet is conveyed to the conveying path 19.

A pair of side guides 36 which are provided for the bottom plate 37 such that they are separated in the left-right direction 102 can move relative to the bottom plate 37 in the left-right direction 102. Not shown in the figures, the pair of side guides 36 are interlocked with each other by a mechanism constructed under the bottom plate 37. Therefore, when one of the side guides 36 is moved toward a center of the bottom plate 37 in the left-right direction 102, the other of them is also moved, in connection with the movement of the one, to the center thereof in the left-right direction 102. Accordingly, the side guides 36 constituting the pair are positioned symmetrical to the center of the bottom plate 37 in the left-right direction 102. The side guides 36 constituting the pair are moved in accordance with a width of the plurality of sheets placed on the bottom plate 37, whereby both sides of a bundle of the plurality of sheets are supported by the side guides 36, and a center of the sheets becomes identical with the center of the bottom plate 37.

The first slide portion 34 is connected to a front portion of the body portion 31 such that a part of the first slide portion 34 covers a part of the bottom plate 37 and side walls 38 of the body portion 31 from their outsides so as to overlap with the part of the first slide portion 34. The first slide portion 34 has a bottom plate 41 and side walls 42 rising upward from both edges of the bottom plate 41 in the left-right direction 102. The bottom plate 41 is connected to the bottom plate 37 of the body portion 31 under the bottom plate 37 by means of a known mechanism such as a rail, and thus can slide relative to the bottom plate 37 in the front-rear direction 103. The side walls 42 have respective long holes 44 extending in the front-rear direction 103. The long holes 44 are engaged by respective L-shaped protrusion pieces 43 each of which protrudes outward from the corresponding side wall 38 in the left-right direction 102, whereby the protrusion pieces 43 can move in the front-rear direction 103, while being guided by the long holes 44. Therefore, the side walls 42 can also slide relative to the side walls 38 of the body portion 31 in the front-rear direction 103.

The second slide portion 35 is connected to a front portion of the first slide portion 34 such that a part of the second slide portion 35 covers a part of the bottom plate 41 and side walls 42 of the first slide portion 34 from their outsides so as to overlap with the part of the second slide portion 35. The second slide portion 35 has a bottom plate 45, side walls 46 rising upward from both edges of the bottom plate 45 in the left-right direction 102, and a front face wall 47 rising upward from an upstream-side edge of the bottom plate 45 in the sheet supplying direction 104 (the front side of the printer unit 11). The bottom plate 45 is connected to the bottom plate 41 of the first slide portion 34 under the bottom plate 41 by means of a known mechanism such as a rail, and thus can slide relative to the bottom plate 41 in the front-rear direction 103. The side walls 46 have respective L-shaped protrusion pieces 48 each of which protrudes inward in the left-right direction 102. The protrusion pieces 48 engage respective upper edge of the side walls 42 of the first slide portion 34, whereby the protrusion pieces 48 can move in the front-rear direction 103, while being guided by the upper edges. Therefore, the side walls 46 can also slide relative to the side walls 42 of the first slide portion 34 in the front-rear direction 103.

The body portion 31 is constructed of the base portion 33, the first slide portion 34, and the second slide portion 35. The body portion 31 has a shape like a box whose upper side has an opening portion. A second discharged tray 32 is connected to the second slide portion 35 so as to cover a part, near to the front face wall 47, of the opening portion of the body portion 31.

As shown in FIGS. 3-6, the second discharged tray 32 has a tray body 49 for supporting the sheets, a sub-tray 50 provided for the tray body 49, two pairs of link members 51, 52, and connection members 53, 54 each of which connects corresponding one of the two pairs of link members 51, 52 to each other. The tray body 49 and the sub-tray 50 is an example of a second support portion. The sub-tray 50 is an example of a swing member.

The tray body 49 has a pair of side plates 55 arranged in the left-right direction 102, and a middle plate 56 connecting the pair of side plates 55 to each other. Each of the side plates 55 has a structure having two stages in the front-rear direction 103, in which one of the stages placed nearer to the inclined plate 39 of the body portion 33 is positioned lower than the other of the stages and the other of the stages placed nearer to the front face wall 47 is positioned higher than the one of the stages, and in which the lower stage and the higher stage are continuously connected by inclined portions of the pair of side plates 55. The middle plate 56 is disposed between the side plates 55 at the higher stage and the inclined portions so as to connect the side plates 55 to each other, that is, the middle plate 56 does not exist in the lower stage. A top surface of the middle plate 56 is lower than upper surfaces of the side plates 55 at the higher stage, resulting in forming steps between the middle plate 56 and the pair of side plates 55. Therefore, the upper surface of the middle plate 56 is recessed downward relative to the upper surfaces of the side plates 55 at the higher stage.

The sub-tray 50 is provided so as to cover the middle plate 56 of the tray body 49. The sub-tray 50 is flat as a whole, however, is curved such that its shape matches with the higher stage and the inclined portions of the pair of side plates 55 of the tray body 49. From both edges of the sub-tray 50 in the left-right direction 102, respective ones of a pair of shafts 57 are protruded outward. The pair of shafts 57 are inserted into holes 58 which are formed at positions near to the front face wall 47 of the body portion 31 in the tray body 49 and at the steps between the side plates 55 and the middle plate 56, whereby the sub-tray 50 is connected to the tray body 49 such that it is allowed to swing. The sub-tray 50 can be swung to a first swing position (sec FIGS. 3 and 5) in which the sub-tray 50 covers the upper surface of the middle plate 56 of the tray body 49 and a second swing position (see FIGS. 4 and 6) in which the sub-tray 50 extends obliquely upward from the tray body 49. The sub-tray 50 is maintained at the first swing position by being placed on the upper surface of the tray body 49 and maintained at the second swing position by coming into abutting contact with the middle plate 56 of the tray body 49.

The two pairs of link members 51, 52 are connected to the tray body 49 at its bottom face side such that the link members 51, 52 are allowed to swing. At the bottom face, recessed portions allowed to accommodate the link members 51, 52 are formed. The link members 51 constituting the pair are separated away from each other in the left-right direction 102. Each of the link members 51 is arranged outside the respective link members 52 constituting the another pair in the left-right direction 102. Each of the link members 51 constituting the pair is an elongated member having an arm-shape. Each of one ends of the link members 51 has a shaft 59 and each of the other ends of the link members 51 has a shaft 60. The shafts 59 are rotatably connected to the tray body 49 and the shafts 60 are rotatably connected to the side walls 46 of the second slide portions 35 of the body portion 31. The link members 51 constituting the pair each of which has the arm-shape are connected to each other at their center portions by the connection member 53 which extends in the left-right direction 102.

The link members 52 constituting the pair are separated away from each other in the left-right direction 102, and are arranged inside the respective link members 51 constituting the pair in the left-right direction 102. Each of the link members 52 constituting the pair is an elongated member having an arm-shape. Each of one ends of the link members 52 has a shaft 61 and each of the other ends of the link members 52 has a shaft 62. The shafts 61 are rotatably connected to the tray body 49 and the shafts 62 are rotatably connected to the front face wall 47 of the second slide portions 35 of the body portion 31. The link members 52 constituting the pair each of which has the arm-shape are connected to each other at their center portions by the connection member 54 which extends in the left-right direction 102.

Figure 5:
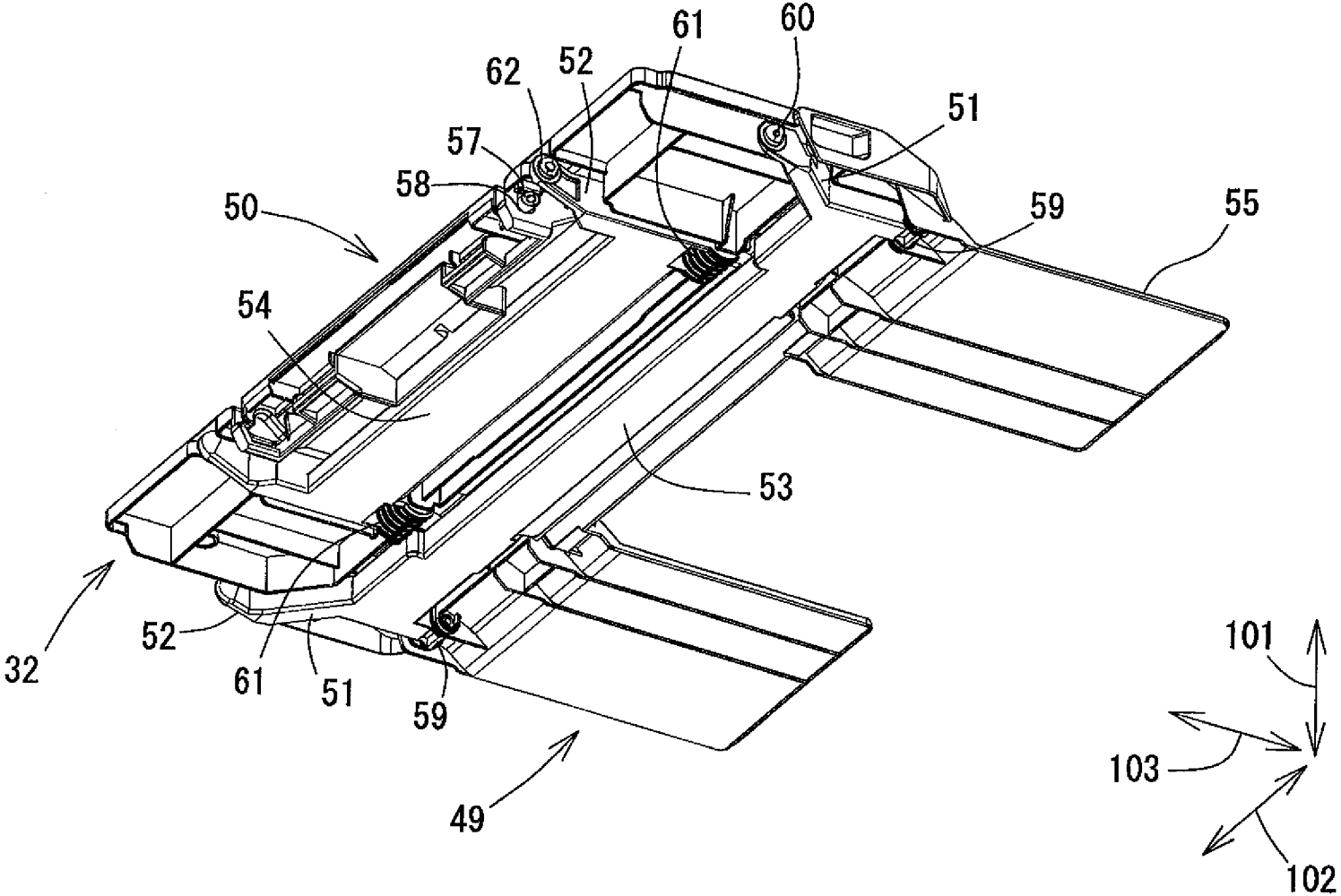
FIG. 5 is a perspective view showing a bottom side structure of the second discharged tray 32 in the first posture.
Figure 6:
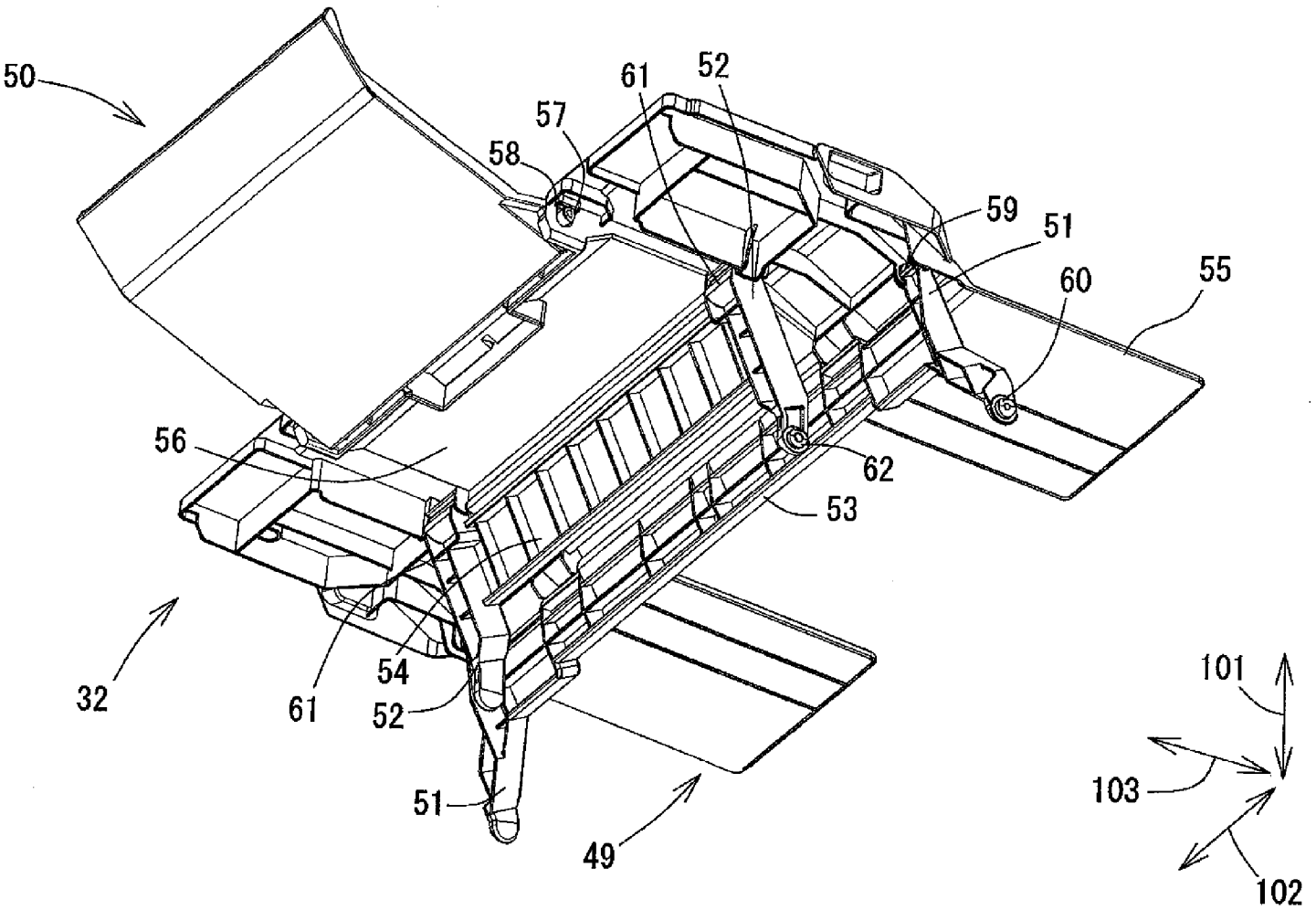
FIG. 6 is a perspective view showing the bottom side structure of the second discharged tray 32 in the second posture.

As shown in FIG. 5, the two pairs of link members 51, 52 are individually folded with respect to the tray body 49, and are spaced apart from each other in the front-rear direction 103 in order not to conic into abutting contact with each other in folded states. The shafts 59 of the link members 51 constituting the pair are arranged behind the respective shafts 61 of the link members 52 constituting the pair in the front-rear direction 103. The shafts 60 of the link members 51 constituting the pair are arranged behind the respective shafts 62 of the link members 52 constituting the pair in the front-rear direction 103. In the folded states in which the two pairs of link members 51, 52 are individually folded with respect to the tray body 49, a part of the pair of the link members 51 is positioned behind the pair of the link members 52 in the front-rear direction 103.

As shown in FIGS. 3 and 4, the second discharged tray 32 changes its posture, by the swings of the two pairs of link members 51, 52, to a first posture in which the second discharged tray 32 covers the part, near to the front face wall 47, of the opening portion of the body portion 31 and to a second posture in which the second discharged tray 32 separates away from the opening portion of the body portion 31 and in which the second discharged tray 32 is positioned higher than in the first posture. That is, when the second discharged tray 32 is in the first posture, a position of the second discharged tray 32 is an example of a first position, and when the second discharged tray 32 is in the second posture, the position of the second discharged tray 32 is an example of a second position. Accordingly, the second discharged tray 32 is movable between the first position and the second position by the swings of the two pairs of link members 51, 52. The tray body 49 of the second discharged tray 32 is supported by the side walls 46 of the second slide portion 35 and an upper edge of the front face wall 47, whereby the second discharged tray 32 is maintained in the first posture. The link members 52, which constitute the front one in the front-rear direction 103 of the two pairs of link members 51, 52, come into abutting contact with an upper edge portion of the front face wall 47 of the second slide portion 35, whereby the second discharged tray 32 is maintained in the second posture. The upper edge portion of the front face wall 47 is an example of a contact portion.

Second Sheet Supply Cassette 16

Figure 9:
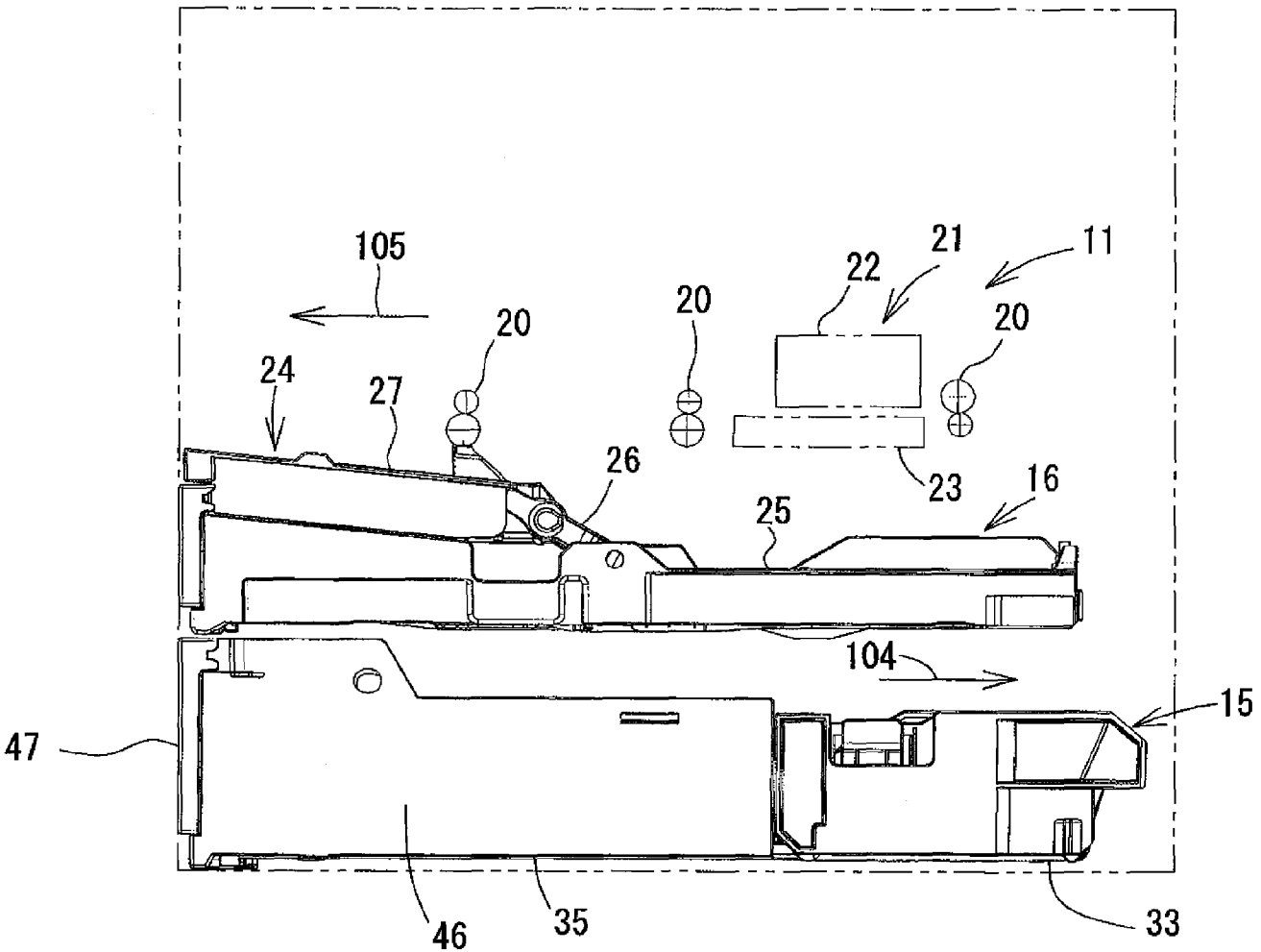
FIG. 9 is a side view showing the first sheet supply cassette 15 and a second sheet supply cassette 16 in a state in which the first discharged tray 24 and the second discharged tray 32 are accommodated in the printer unit 11.
Figure 9:
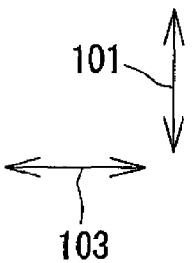

As shown in FIGS. 1 and 9, the second sheet supply cassette 16 has a body portion 25 having a shape like a box whose upper side has an opening portion. The body portion 25 has a size in which the sheet of the A4 size is arranged such that a short side of the sheet extends in the front-rear direction 103. The first discharged tray 24 is arranged so as to close the opening portion of a front portion (a left side in FIG. 9) of the body portion 25. The first discharged tray 24 is connected to the body portion 25 by a pair of link members 26. The link members 26 are allowed to swing relative to the first discharged tray 24 and the body portion 25. The first discharged tray 24 is allowed to swing relative to the body portion 25 in association of the swings of the link members 26. When the first discharged tray 24 is swung upward relative to the body portion 25, the opening portion of the body portion 25 is opened, and thus the sheets can be loaded on the body portion 25 from the opening portion. A top face of the first discharged tray 24 which supports the sheets is an example of a first support portion.

Figure 7:
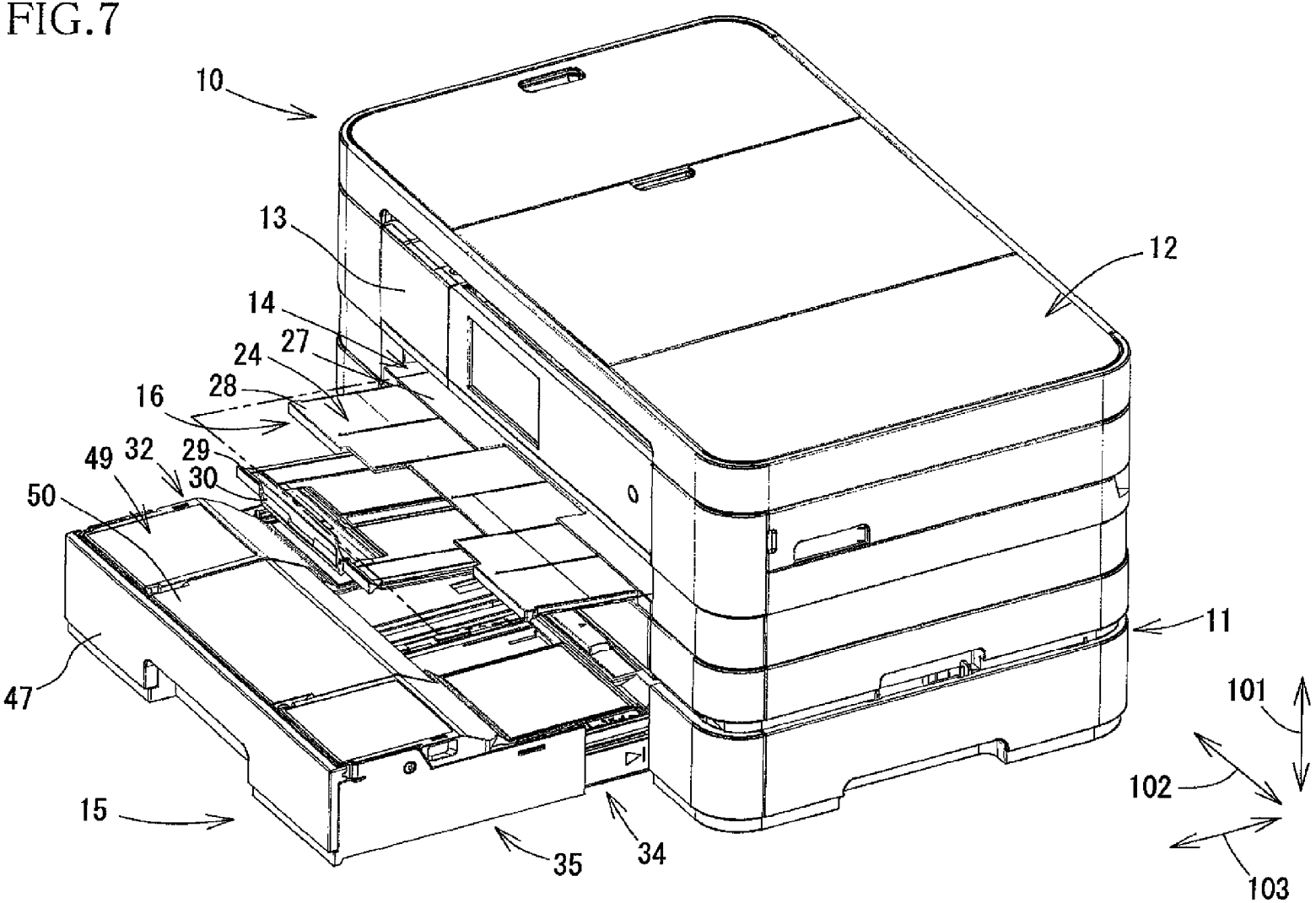
FIG. 7 is a perspective view showing the overview of the structure of the MFP 10 in a state in which slide trays 28, 29 have been pulled out of a first discharged tray 24.
Figure 10:
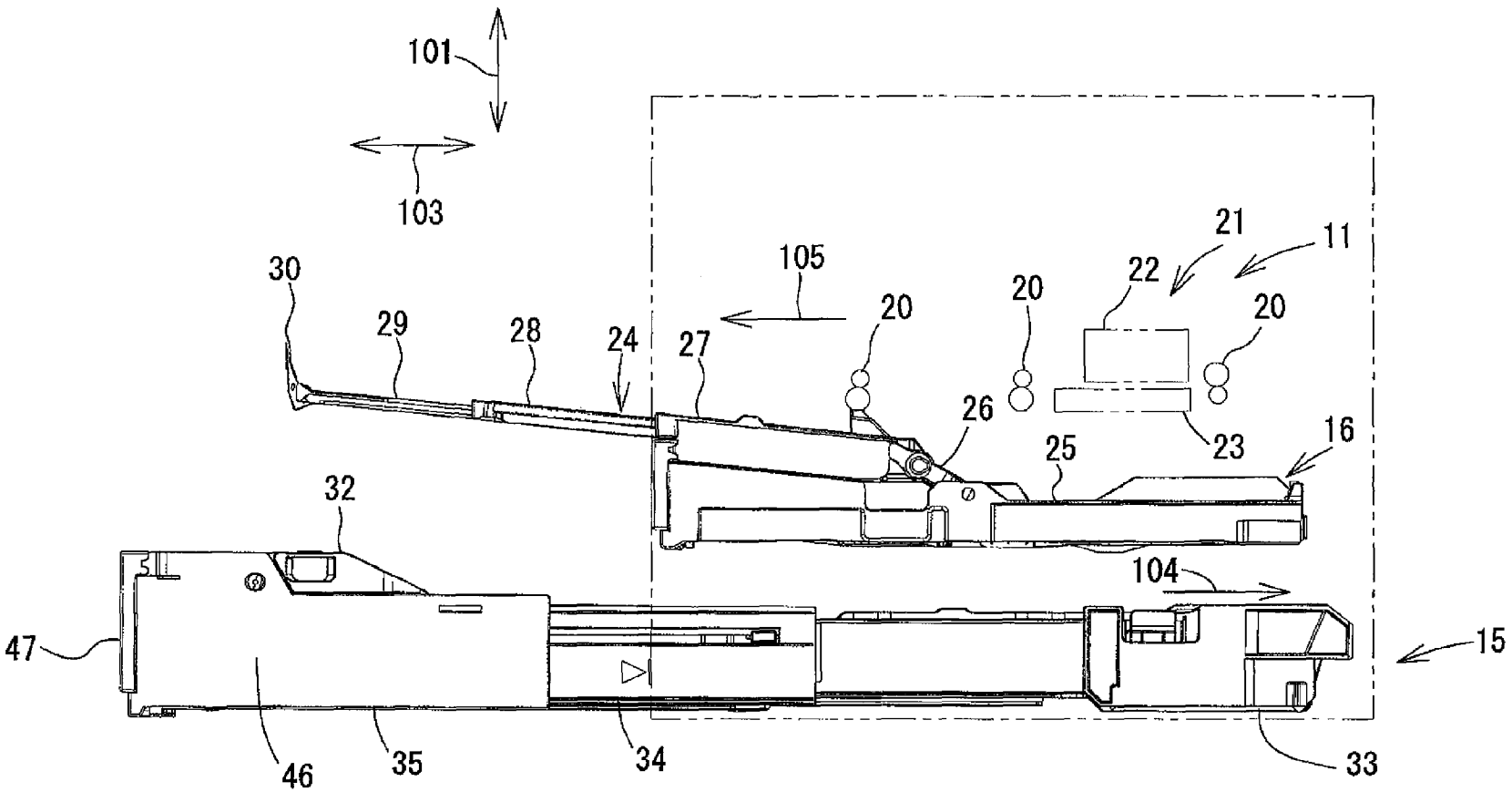
FIG. 10 is a side view showing the first sheet supply cassette 15 and the second sheet supply cassette 16 in a state in which the slide trays 28, 29 have been pulled out of the first discharged tray 24.

As shown in FIGS. 7 and 10, slide trays 28, 29 extending forward with respect to the printer unit 11 are provided for the discharged tray 24. The slide tray 28 has a flat shape, and is connected to a tray body 27 having a flat shape such that the slide tray 28 can slide under a bottom face of the tray body 27. The slide tray 29 has a flat shape, and is slidably connected to the slide tray 28 on its bottom face. The slide tray 29 is smaller in the left-right direction 102 than the slide tray 28, and a center of the slide tray 29 is placed in a center of the slide tray 28 in the left-right direction 102.

In a front end of the conveying path 29, a stopper 30 is provided. The stopper 30 is allowed to be swung to a folded position in which the stopper 30 covers an upper face of the slide tray 29 and to a protrusion position in which the stopper 30 protrudes obliquely upward. A length of the tray body 27 is shorter in the front-rear direction 103 than a length of the short side of the A4 size, i.e. 210 mm. Therefore, in a state in which the slide trays 28, 29 are retracted in the tray body 27, the first discharged tray 24 has a size in which the sheet of a photo size (having a long side of 127 mm) and a post card size (having a long side of 148 mm) can be supported. In a state in which the slide trays 28, 29 are pulled out of the tray body 27, a length of the first discharged tray 24 is slightly longer in the front-rear direction 103 than a length of the short side of the A4 size. Therefore, pulling out the slide trays 28, 29 enables the first discharged tray 24 to support the sheet of the A4 size.

Usage of Printer Unit 11

As shown in FIGS. 1 and 9, when no sheet of the A3 size is loaded on the first sheet supply cassette 15, the first slide portion 34 and the second slide portion 35 are pushed and slid rearward (toward the inclined plate 39) relative to the base portion 33 of the body portion 31 so as to shorten a length of the first sheet supply cassette 15 to the minimum, whereby a size of the first sheet supply cassette 15 in the front-rear direction 103 is reduced. Additionally, the second discharged, tray 32 is in the first posture in which the part of the opening portion of the body portion 31 is closed. In this state, the front face wall 47 of the first sheet supply cassette 15 is flush with the front face of the printer unit 11, and thus the first sheet supply cassette 15 is completely accommodated in the inside space of the printer unit 11. In addition, the slide trays 28, 29 of the first discharged tray 24 are slid and positioned under the bottom face of the tray body 27, and thus the second sheet supply cassette 16 is also completely accommodated in the inside space of the printer unit 11. In such a state, the sheet having a size smaller than the A4 size can be accommodated in the first sheet supply cassette 15 and the second sheet supply cassette 16 so that the long side of the sheet extends in the front-rear direction 103. For example, when the sheet of the photo size or the post card size is accommodated in the first sheet supply cassette 15 or the second sheet supply cassette 16 and an image is recorded on the sheet, this image recording is carried out in the state shown in FIGS. 1 and 9.

For example, when an image is recorded on the sheet of the A4 size accommodated in the first sheet supply cassette 15 or the second sheet supply cassette 16, the slide trays 28, 29 of the first discharged tray 24 are pulled out and the stopper 30 is positioned at the protrusion position, as shown in FIGS. 7 and 10. Consequently, the sheet of the A4 size on which the image had been recorded is supported by the first discharged tray 24 (an outline is indicated by an alternate long and two short dashes line in FIG. 7). Incidentally, it is to be understand that, though, as shown in FIGS. 7 and 10, the first sheet supply cassette 15 is extended so that its front face wall 47 protrudes from the inside space of the printer unit 11, an image can be recorded on the sheet of the A4 size when the first sheet supply cassette 15 is completely accommodated in the inside space of the printer unit 11 and only the first discharged tray 24 is protruded from the inside space of the printer unit 11, as shown in FIGS. 1 and 9.

Figure 8:
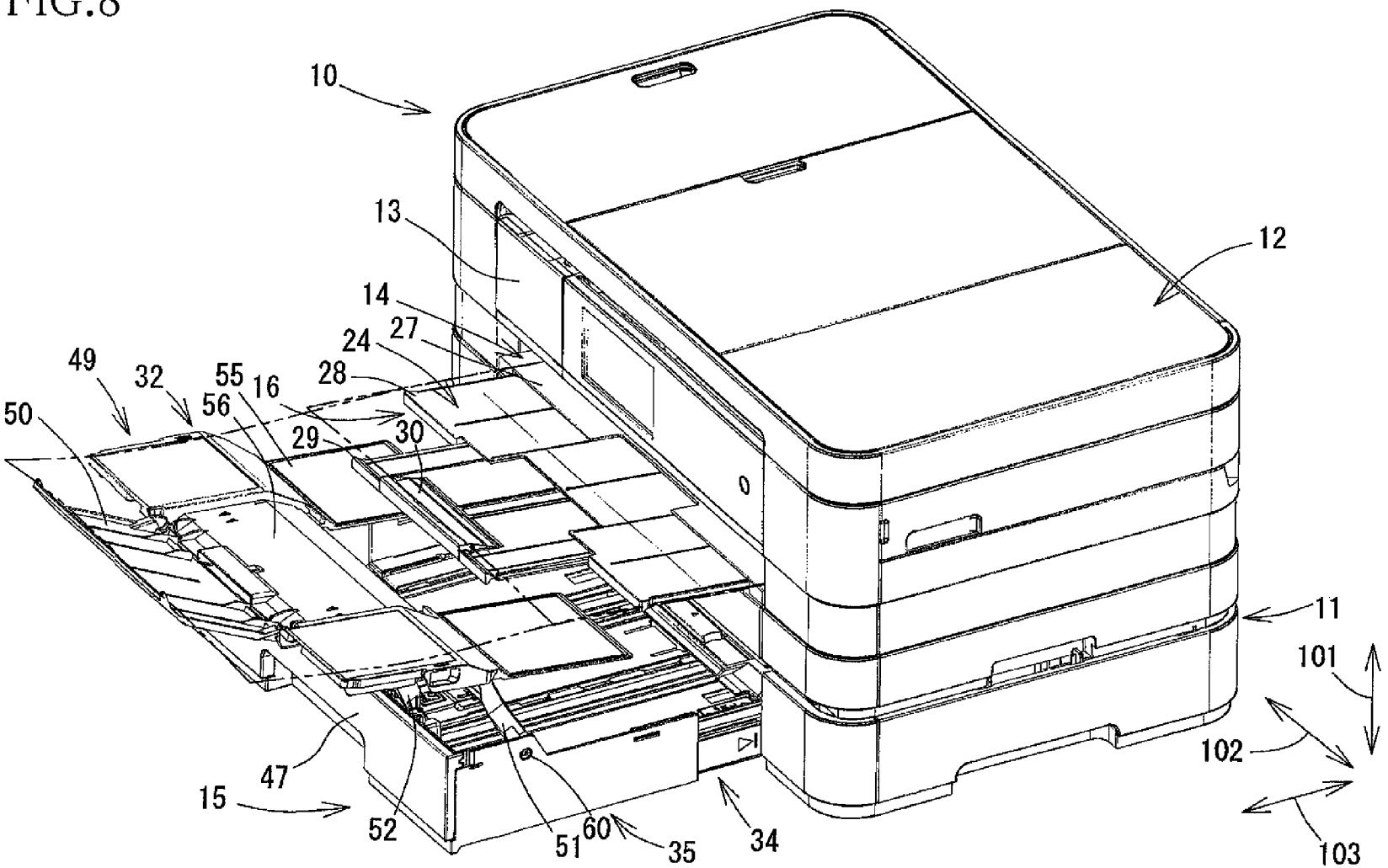
FIG. 8 is a perspective view showing the overview of the structure of the MFP 10 in a state in which the second discharged tray 32 is in the second posture.
Figure 11:
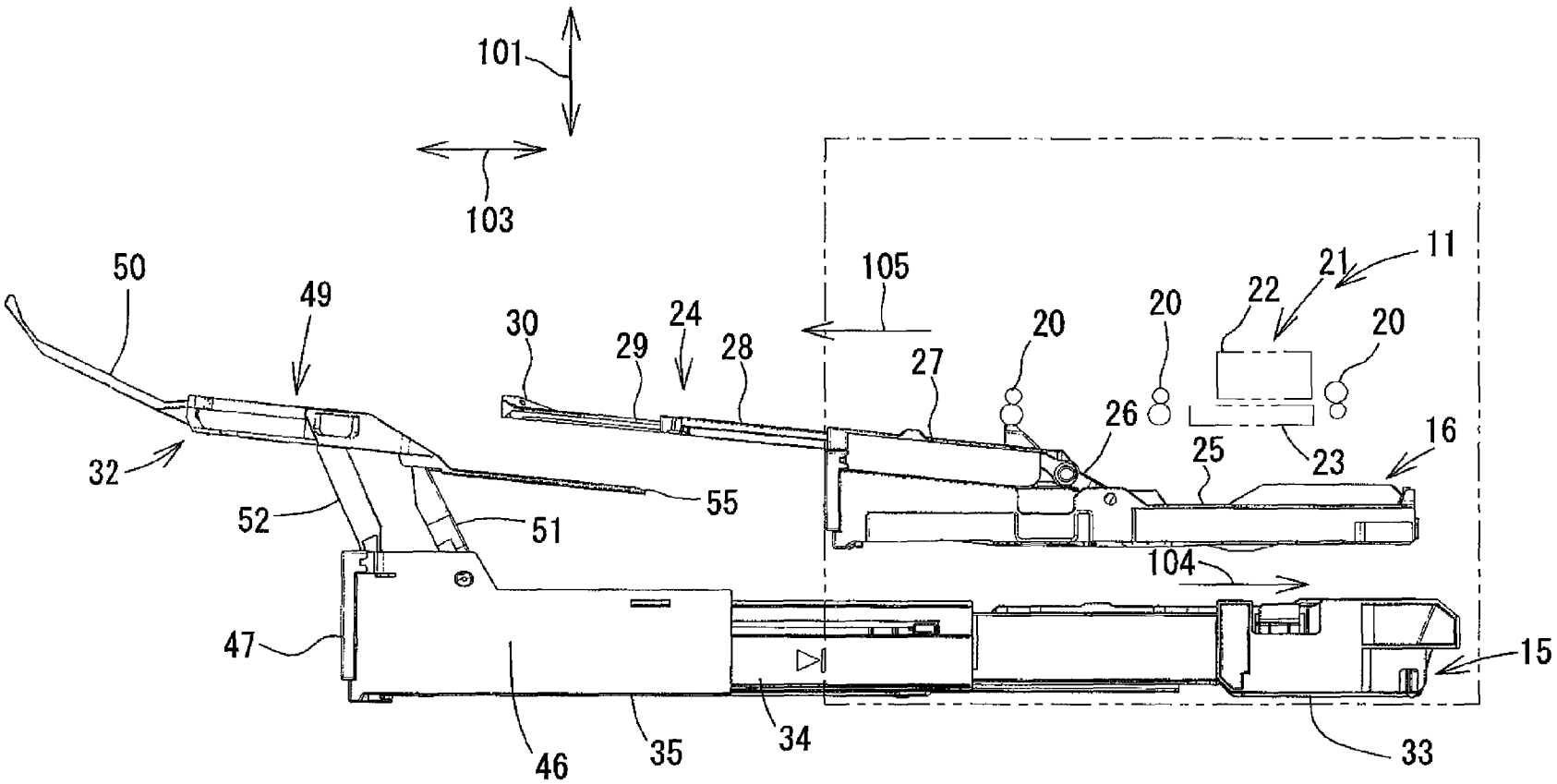
FIG. 11 is a side view showing the first sheet supply cassette 15 and the second sheet supply cassette 16 in a state in which the slide trays 28, 29 have been pulled out of the first discharged tray 24 and in which the second discharged tray 32 is in the second posture.

When an image is recorded on the sheet of the A3 size, the slide trays 28, 29 are pulled out in the first discharged tray 24, as shown in FIGS. 8 and 11, However, the stopper 30 is maintained in the folded position. Additionally, in the body portion 31 of the first sheet supply cassette 15, the first slide portion 34 and the second slide portion 35 are pulled out from the base portion 33 so that a length of the body portion 31 in the front-rear direction 103 fits to a long side of the A3 size. Consequently, the sheet of the A3 size can be accommodated in the body portion 31. Additionally, the second slide portion 35 of the first sheet supply cassette 15 is outwardly pulled out of the inside space of the printer unit 11. The second discharged tray 32 is also outwardly pulled out of the inside space of the printer unit 11 in association with the slide of the second slide portion 35. Thus, the second sheet supply cassette 16 and so on are not positioned above the second discharged tray 32, thereby allowing the second discharged tray 32 to be swung upward. That is, the second discharged tray 32 is allowed to swing from the first posture to the second posture.

When the second discharged tray 32 is put in the second posture, a part of the tray body 49 is positioned in a downstream side of the slide trays 28, 29 of the first discharged tray 24 in a discharge direction 105. In detail, the higher stage of the pair of side plates 55 (a downstream end side of the pair of side plates 55 in the discharge direction 105) and the inclined portions of the tray body 49 are positioned in the downstream side of the slide trays 28, 29 in the discharge direction 105, while the lower stage of the pair of side plates 55 (an upstream end side of the pair of side plates 55 in the discharge direction 105) are positioned below the slide trays 28. 29. In other words, a downstream end of the tray body 49 in the discharge direction 105 is positioned in the downstream side of a downstream end of the slide tray 29 in the discharge direction 105, and an upstream end of the tray body 49 in the discharge direction 105 is positioned below the downstream end of the slide tray 29 in the discharge direction 105 (that is, a position of the upstream end of the tray body 49 is lower in an up-down direction than the downstream end of the slide tray 29 in the discharge direction 105).

Moreover, in the second discharged tray 32 in the second posture, the sub-tray 50 is swung from a folded position (the first swing position) to the protrusion position (the second swing position). A position of the downstream end in the discharge direction 105 of the sub-tray 50 positioned in the protrusion position is above the slide trays 28, 29. That is, the position of the downstream end of the sub-tray 50 in the discharge direction 105 is higher in the up-down direction than the downstream end of the slide tray 29 in the discharge direction 105.

The sheet of the A3 size is supplied by the first sheet supply roller 7 from the first sheet supply cassette 15 to the conveying path 19. Then, an image is recorded on the sheet in the recording portion 21, and the sheet is discharged on the first discharged tray 24. In a state in which the slide trays 28, 29 are pulled out of the tray body 27, since the length of the first discharged tray 24 is slightly longer in the front-rear direction 103 than a length of the long side of the A4 size, a leading edge of the sheet of the A3 size passes over the first discharged tray 24.

The leading edge of the sheet having passed over the first discharged tray 24 reaches to the tray body 49 of the second discharged tray 32. Since the upstream end of the tray body 49 in the discharge direction 105 is positioned below the slide tray 28, the leading edge of the sheet smoothly moves from the first discharged tray 24 to the tray body 49.

In the tray body 49, since the upper surface of the middle plate 56 is recessed downward relative to the upper surfaces of the pair of the side plates 55, the leading edge of the sheet fits to shapes of the upper surfaces of the side plates 55 and the middle plate 56, and moves on the upper surfaces of the tray body 49 while it is bent such that a center of the leading edge of the sheet is lower than both edges of the sheet.

Then, the leading edge of the sheet moves from the tray body 49 to the sub-tray 50. Since a length between an upstream end of the first discharged tray 24 in the discharge direction 105 and a downstream end of the sub-tray 50 in the discharge direction 105 is longer than a length of the long side of the A3 size, the sheet of the A3 size settles in a state in which it is supported by both of the first discharged tray 24 and the second discharged tray 32. In addition, since the sub-tray 50 is shaped to be curved along the shape of the pair of the side plates 55, a downstream end of the sub-tray 50 extends more upward than an upstream end of the sub-tray 50. Therefore, the downstream end of the sub-tray 50 functions as a stopper for preventing a fall-out of the sheet.

Working Effect of the Embodiment

As described previously, according to the embodiment, when the second discharged tray 32 is put in the second posture, the sheet of the A3 size is supported by both of the first discharged tray 24 and the second discharged tray 32, and thus the sheet is prevented from falling out of the first discharged tray 24.

Since the upstream end of the tray body 49 of the second discharged tray 32 in the discharge direction 105 is positioned below the slide trays 28, 29 of the first discharged tray 24, the leading edge of the sheet can smoothly move from the first discharged tray 24 to the second discharged tray 32.

Additionally, since the downstream end of the sub-tray 50 of the second discharged tray 32 in the discharge direction 105 is positioned above the first discharged tray 24, the leading edge of the sheet in the discharge direction 105 does not hang down from the first discharged tray 24. This can prevent the trailing edge of the sheet in the discharge direction from lifting up from the tray body 27 of the first discharged tray 24. Therefore, it is prevented that a next sheet to be subsequently discharged comes into under the previously discharged sheet, or comes into abutting contact with the previously discharged sheet, thereby causing a paper jam.

Additionally, since the second discharged tray 32 is connected to the second slide portion 35 of the first sheet supply cassette 15, it is easy for a user to understand that handling the second discharged tray 32 is needed in association with a slide of the second slide portion 35 for accommodating the sheets of the A3.

Since the second discharged tray 32 is allowed to be handled when the second discharged tray 32 is outside the inside space of the printer unit 11, handling the second discharged tray 32 from the first posture to the second posture is easy.

Since the second discharged tray 32 is connected to the second slide portion 35 of the first sheet supply cassette 15 by the two pairs of link members 51, 52, the posture of the second discharged tray 32 is changed with a simple structure.

Since the two pairs of link members 51, 52 are arranged in different positions relative to the tray body 49 in the left-right direction 102, the two pairs of link members 51, 52 are overlapped in the discharge direction while the link members do not interfere with each other, when the second discharged tray 31 is put in the first posture.

Since the link members 51 constituting the pair are connected to each other by the connection member 53, motions of the two link members 51 constituting the pair are surely synchronized. Similarly, since the link members 52 constituting the pair are connected to each other by the connection member 54, motions of the two link members 52 constituting the pair are surely synchronized.

Since the link members 52 come into abutting contact with the upper edge portion of the front face wall 47 of the first sheet supply cassette 15, the second discharged tray 32 is maintained in the second posture. Therefore, the second discharged tray 32 can be maintained in the second posture with a simple structure.

Since the first sheet supply cassette 15 is disposed above the second sheet supply cassette 16, puttin the second discharged tray 32 in the first posture results in a shorter distance between the first sheet supply cassette 15 and the second sheet supply cassette 16. Therefore a downsizing of the printer unit 11 is realized.

Since the second discharged tray 32 functions as a cover which closes the opening portion of the body portion 31 of the first sheet supply cassette 15, the number of components of the printer unit 11 is reduced.

In the tray body 49, since the upper surface of the middle plate 56 is recessed downward relative to the upper surfaces of the pair of the side plates 55, the sheet is bent so as to fit to such a shape of the tray body 49, and the sheet become hard to be bent in the discharge direction 105.

Additionally, since the sub-tray 50 is provided for the tray body 49 of the second discharged tray 32 with the sub-tray 50 being allowed to swing, the sub-tray 50 fanctions as a stopper without enlarging the second discharged tray 32 more than necessary.

Second Embodiment

A second embodiment according to the present invention is described below. A structure of the second embodiment is almost the same as that of the first embodiment except for a structure of the second discharged tray 32. Accordingly, a structure different from the structure of the first embodiment is described in detail.

Figure 12:
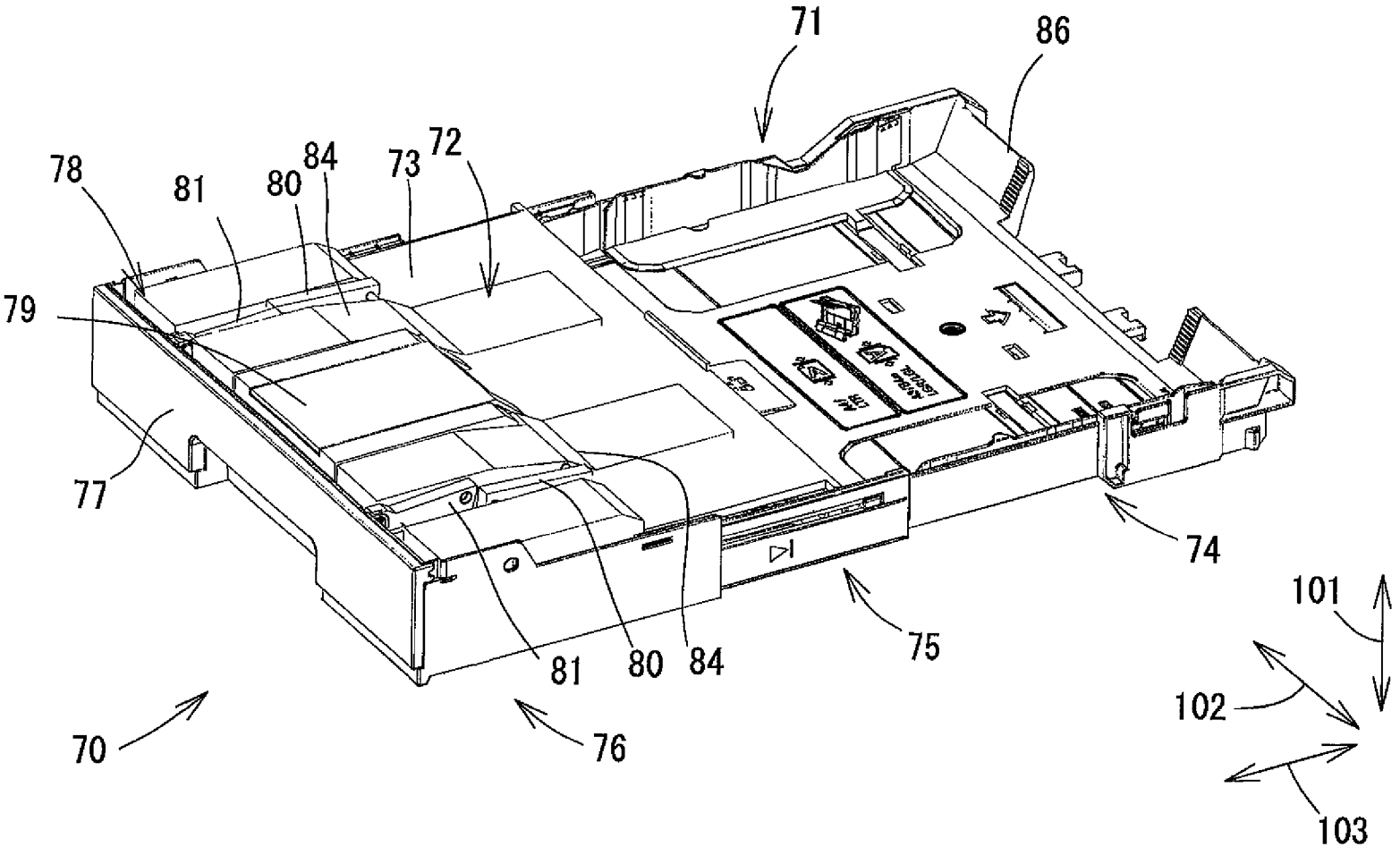
FIG. 12 is a perspective view showing an overview of a structure of a first sheet supply cassette 70 as a second embodiment according to the present invention.

As shown in FIG. 12, the first sheet supply cassette 70 has a body portion 71 configured to accommodate the sheets, a second discharged tray 72 provided for the body portion 71, and a cover 73.

The body portion 71 has, like the body portion 31 of the first embodiment, a base portion 74, a first slide portion 75, undo second slide portion 76. And the body portion 71 is a plastic part like a tray showing a rectangular shape in top view and being deformable by its slide so that its size corresponds to an approximate A4 size and an approximate A3 size. That is, the body portion 71 can be deformed by its slide so as to have a size in which the sheet of the A4 size is arranged such that a short side of the sheet extends in the front-rear direction 103, and so as to have a size in which the sheet of the A3 size is arranged such that a long side of the sheet extends in the front-rear direction 103. Descriptions of detail structures of these components are omitted here. The body portion 71 has a shape like a box whose upper side has an opening portion, and is provided with a cover 73 such that the cover 73 covers apart, nearer to a front face wall 77, of the opening portion of the body portion 71. The cover 73 has, in the left-right direction 102, a width equal to a width of the body portion 71, and is placed on side walls of the body portion 71.

Figure 13:
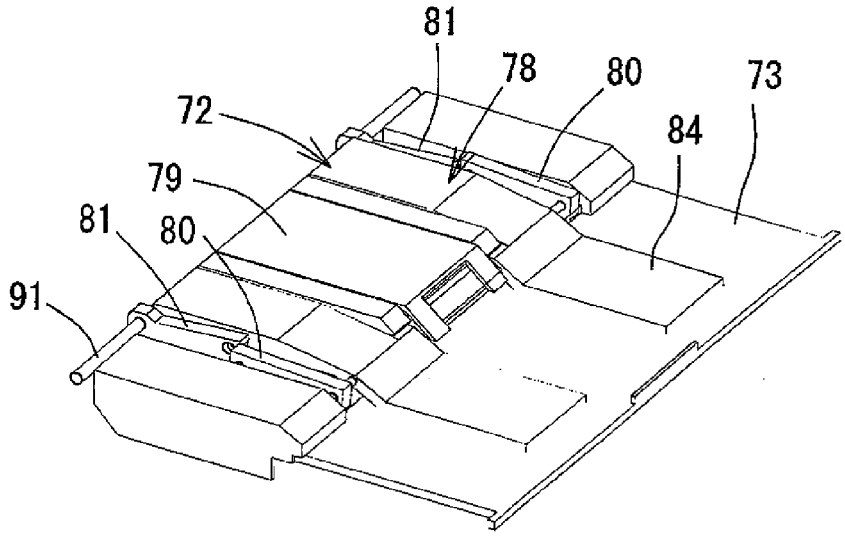
FIG. 13 is a perspective view showing a second discharged tray 72 in the first posture.
Figure 14:
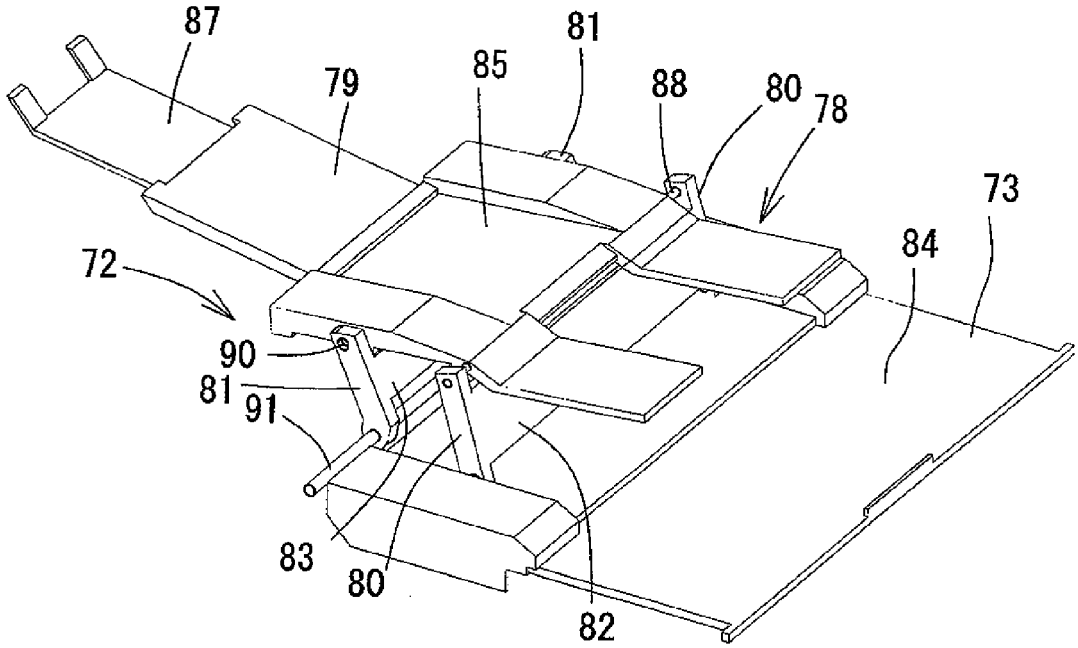
FIG. 14 is a perspective view showing the second discharged tray 72 in the second posture.

As shown in FIGS. 13 and 14, the second discharged tray 72 has a tray body 78 for supporting the sheets, a sub-tray 79 provided for the tray body 78, two pairs of link members 80, 81, connection members 82, 83 each of which connects corresponding one of the two pairs of link members 80, 81 to each other, and an expansion tray 87 provided for the sub-tray 79. The tray body 78, the sub-tray 79, and the expansion tray 87 is an example of a second support portion. The sub-tray 79 and the expansion tray 87 is an example of a swing member.

The tray body 78 has a pair of side plates 84 arranged in the left-right direction 102, and a middle plate 85 connecting the pair of side plates 84 to each other. Each of the side plates 84 has a structure having two stages in the front-rear direction 103, in which one of the stages placed nearer to the inclined plate 86 of the body portion 71 is positioned lower than the other of the stages and the other of the stages placed nearer to the front face wall 77 is positioned higher than the one of the stages, and in which the lower stage and the higher stage are continuously connected by an inclined portions of the pair of side plates 84. The middle plate 85 is disposed between the side plates 84 at the higher stage and the inclined portions so as to connect the side plates 84 to each other, that is, the middle plate 85 does not exist in the lower stage. An upper surface of the middle plate 85 is lower than upper surfaces of the side plates 84, resulting in forming steps between the middle plate 85 and the pair of side plates 84. Therefore, the upper surface of the middle plate 85 is recessed downward relative to the upper surfaces of the side plates 84 at the higher stage.

The sub-tray 79 is provided so as to cover the middle plate 85 of the tray body 78. The sub-tray 79 is flat as a whole. Not shown in the figures, from both edges of the sub-tray 79 in the left-right direction 102, respective ones of a pair of shafts are protruded outward. The pair of shafts are inserted into holes which are formed at positions near to the front face wall 77 of the body portion 71 in the tray body 78 and at the steps between the side plates 84 and the middle plate 85, whereby the sub-tray 79 is connected to the tray body 78 such that it is allowed to swing. The sub-tray 79 can be swung to a first swing position (see FIGS. 12 and 13) in which the sub-tray 79 covers the upper surface of the middle plate 85 of the tray body 78 and a second swing position (see FIGS. 14 and 15) in which the sub-tray 50 extends obliquely upward from the tray body 78. The sub-tray 50 is maintained at the first swing position by being placed on the upper surface of the tray body 78 and maintained at the second swing position by coming into abutting contact with the middle plate 85 of the tray body 78.

The expansion tray 87 is provided such that it is positioned above the sub-tray 79 in the first swing position. The expansion tray 87 can be slid relative to the sub-tray 79 so as to protrude obliquely upward from the sub-tray 79 in the second swing position. The expansion tray 87 extends along an upper surface of the sub-tray 79 in a posture in which the expansion tray 87 protrudes from the sub-tray 79, and a protruding edge of the expansion tray 87 is curved more upward than other portions of the expansion tray 87. When the expansion tray 87 is slid in the sub-tray 79 and the sub-tray 79 is swung to the first swing position, the curved protruding edge has a shape by which the curved protruding edge matches with the higher stage and the inclined portions of the pair of side plates 84 of the tray body 78.

The two pairs of link members 80, 81 are connected to the tray body 78 at its both sides such that the link members 80, 81 are allowed to swing. The link members 80 constituting the pair are separated away from each other in the left-right direction 102, and the link members 81 constituting the pair are separated away from each other in the left-right direction 102. The link members 80 constituting the pair are arranged behind the respective link members 81 constituting the pair in the front-rear direction 103. Additionally, the link members 81 constituting the pair are arranged inside the respective link members 80 constituting the pair in the left-right direction 102. Each of the link members 80, 81 is an elongated member having an arm-shape. At both ends of the link member 80, shafts 88, 89 are provided. The shafts 88 are rotatably connected to the tray body 78 and the shafts 89 are rotatably connected to the cover 73. The link members 80 constituting the pair each of which has the arm-shape are connected to each other at their center portions by the connection member 82 which extends in the left-right direction 102.

At both ends of the link member 81, shafts 90, 91 are provided. The shafts 90 are rotatably connected to the tray body 78 and the shafts 91 are rotatably connected to the side walls of the body portion 71. The link members 81 constituting the pair each of which has the arm-shape are connected to each other at their center portions by the connection member 83 which extends in the left-right direction 102.

As shown in FIG. 13, the two pairs of link members 80, 81 are individually folded with respect to the tray body 78, and are spaced apart from each other in the front-rear direction 103 in order not to come into abutting contact with each other in folded states.

Figure 15:
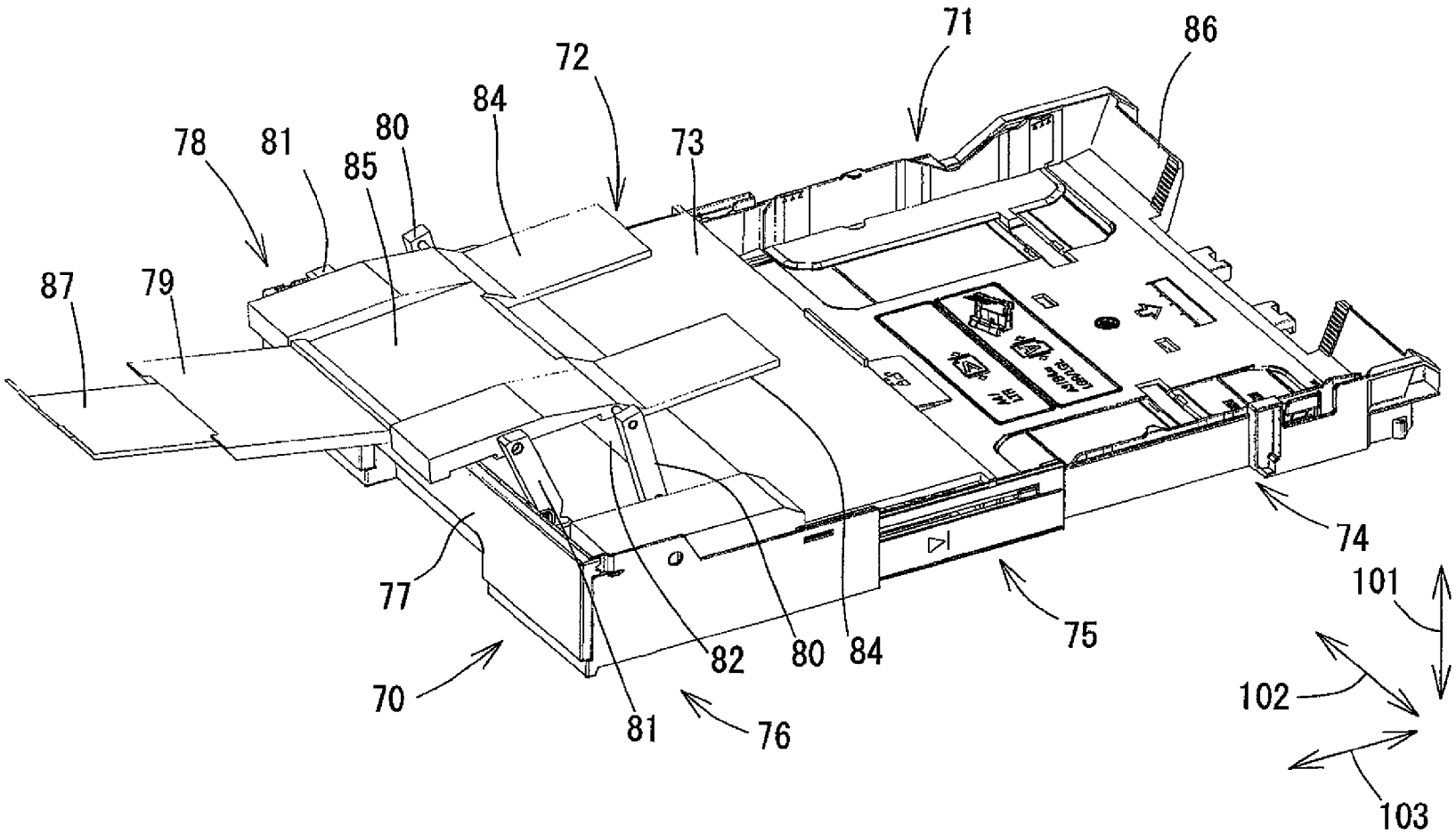
FIG. 15 is a perspective view showing an overview of a structure of the first sheet supply cassette 70 in a state in which the second discharged tray 72 is in the second posture.

As shown in FIGS. 14 and 15, the second discharged tray 72 changes its posture, by the swings of the two pairs of link members 80, 81, to a first posture in which the second discharged tray 72 is positioned on the cover 73 and to a second posture in which the second discharged tray 72 separates away from the cover 73 and in which the second discharged tray 72 is positioned higher than in the first posture. That is, when the second discharged tray 72 is in the first posture, a position of the second discharged tray 72 is an example of a first position, and when the second discharged tray 72 is in the second posture, the position of the second discharged tray 72 is an example of a second position. Accordingly, the second discharged tray 72 is movable between the first position and the second position by the swings of the two pairs of link members 80, 81. The tray body 78 of the second discharged tray 72 is supported by the cover 73, whereby the second discharged tray 72 is maintained in the first posture. The link members 81, which constitutes the front one of the two pairs of link members 80, 81 in the front-rear direction 103, come into abutting contact with an upper edge portion of the front face wall 77 of the body portion 71, whereby the second discharged tray 72 is maintained in the second posture. The upper edge portion of the front face wall 77 is an example of a contact portion.

Figure 16:
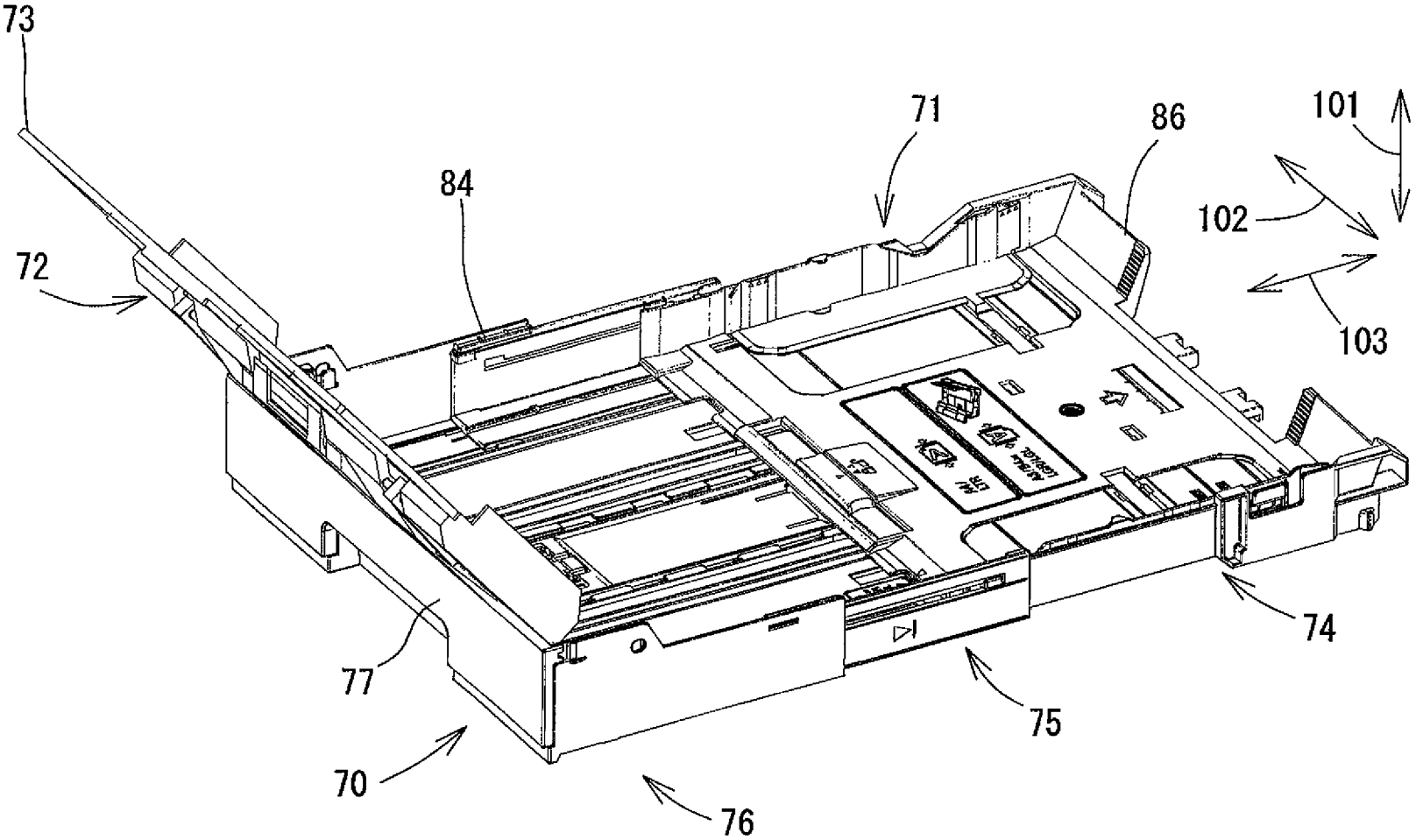
FIG. 16 is a perspective view showing the overview of the structure of the first sheet supply cassette 70 in a state in which a cover 73 has been opened.

As shown in FIG. 16, the cover 73 can rotate together with the second discharged tray 72 around the shafts 91 while the second discharged tray 72 is in the first posture. When the cover 73 is swung upward relative to the body portion 71 so as to separate away from the body portion 71, the opening portion of the body portion is opened, and thus the sheets can be loaded on the body portion 71.

Figure 17:
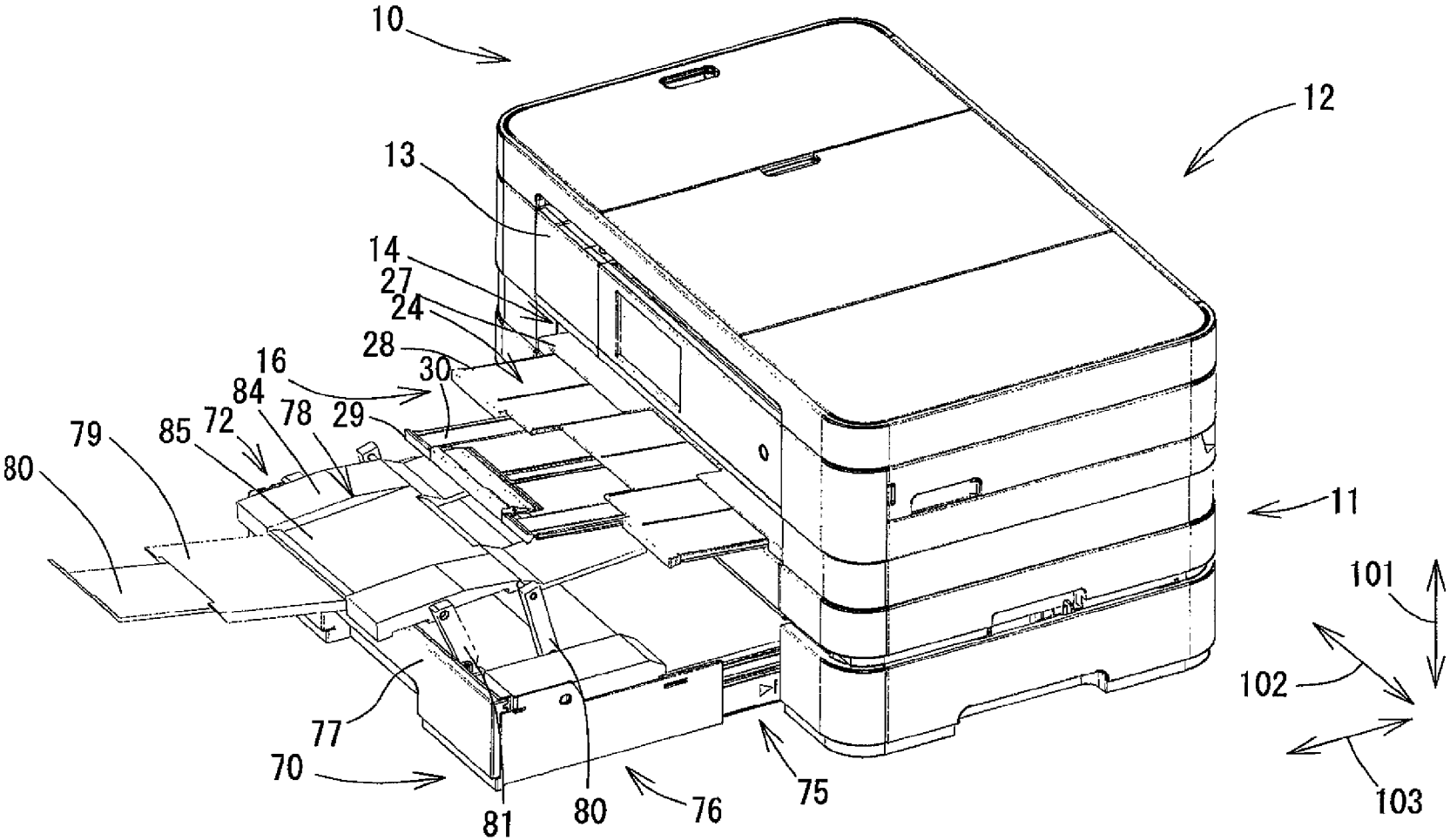
FIG. 17 is a perspective view showing the overview of the structure of the MFP 10 in a state in which the second discharged tray 72 is in the second posture.
Figure 18:
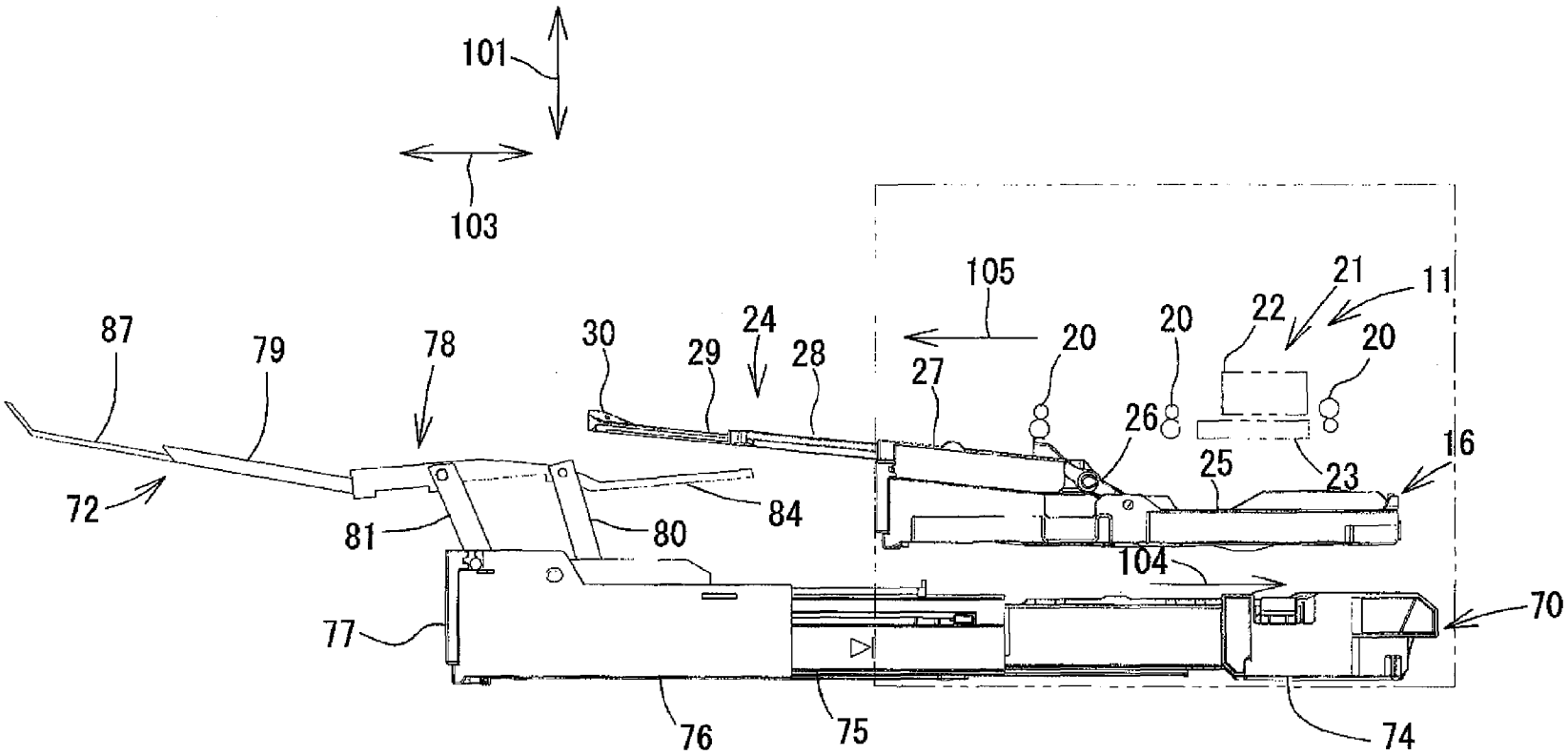
FIG. 18 is a side view showing the first sheet supply cassette 70 and the second sheet supply cassette 16 in a state in which the slide trays 28, 29 have been pulled out of the first discharged tray 24, and in which the second discharged tray 72 is in the second posture.

Like the first embodiment, when an image is recorded on the sheet of the A3 size, the slide trays 28, 29 are pulled out in the first discharged tray 24, as shown in FIGS. 17 and 18. However, the stopper 30 is maintained at the folded position. Additionally, in the body portion 71 of the first sheet supply cassette 70, the first slide portion 75 and the second slide portion 76 are pulled out from the base portion 74 so that a length of the body portion 71 in the front-rear direction 103 fits to the long side of the A3 size. Consequently, the sheet of the A3 size can be accommodated in the body portion 71. Additionally, the second slide portion 76 of the first sheet supply cassette 70 is outwardly pulled out of the inside space of the printer unit 11. The second discharged tray 72 is also outwardly pulled out of the inside space of the printer unit 11 in association with the slide of the second slide portion 76. Thus, the second sheet supply cassette 16 and so on are not positioned above the second discharged tray 72, thereby allowing the second discharged tray 72 to be swung upward. That is, the second discharged tray 72 is allowed to swing from the first posture to the second posture.

When the second discharged tray 72 is put in the second posture, a part of the tray body 87 is positioned in a downstream side of the slide tray 28 of the first discharged tray 24 in the discharge direction 105. In detail, the higher stage (a downstream end side of the pair of side plates 84 in the discharge direction 105) and the inclined portions of the pair of side plates 84 of the tray body 78 are positioned in the downstream side of the slide trays 28, 29 in the discharge direction 105, while the lower stage of the pair of side plates 84 (an upstream end side of the pair of side plates 84 in the discharge direction 105) are positioned below the slide trays 28, 29. In other words, a downstream end of the tray body 78 in the discharge direction 105 is positioned in the downstream side of a downstream end of the slide tray 29 in the discharge direction 105, and an upstream end of the tray body 78 in the discharge direction 105 is positioned below the downstream end of the slide tray 29 in the discharge direction 105 (that is, a position of the upstream end of the tray body 78 is lower in the up-down direction than the downstream end of the slide tray 29 in the discharge direction 105).

Moreover, when the sub-tray 79 is swung to the second swing position and the expansion tray 87 is pulled out of the sub-tray 79 in a state in which the second discharged tray 72 in the second posture, a downstream end of the expansion tray 87 in the discharge direction 105 is positioned above the slide trays 28, 29. That is, a position of the downstream end of the expansion tray 87 in the discharge direction 105 is higher in the up-down direction than the downstream end of the slide tray 29 in the discharge direction 105.

An image is recorded on the sheet of the A3 size in the recording portion 21, and the sheet is discharged onto the first discharged tray 24. In a state in which the slide trays 28, 29 are pulled out of the tray body 27, since the length of the first discharged tray 24 is slightly longer in the front-rear direction 103 than a length of the short side of the A4 size, a leading edge of the sheet of the A3 size passes over the first discharged tray 24.

The leading edge of the sheet having passed over the first discharged tray 24 reaches to the tray body 78 of the second discharged tray 72. Since the upstream end of the tray body 78 in the discharge direction 105 is positioned below the slide trays 28, 29, the leading edge of the sheet smoothly moves from the first discharged tray 24 to the tray body 78.

In the tray body 78, since the upper surface of the middle plate 85 is recessed downward relative to the upper surfaces of the pair of the side plates 84, the leading edge of the sheet fits to shapes of the upper surfaces of the side plates 84 and the middle plate 85, and moves on the upper surfaces of the tray body 78 while it is bent such that a center of the leading edge of the sheet is lower than both edges of the sheet.

Then, the leading edge of the sheet moves sequentially from the tray body 78 to the sub-tray 79 and the expansion tray 87. Since a length between the upstream end of the first discharged tray 24 in the discharge direction 105 and a downstream end of the expansion tray 87 in the discharge direction 105 is longer than the length of the long side of the A3 size, the sheet of the A3 size settles in a state in which it is supported by both of the first discharged tray 24 and the second discharged tray 72. In addition, since the downstream end of the sub-tray 87 extends obliquely upward from an upstream end thereof, the downstream end of the expansion tray 87 functions as a stopper for preventing a fall-out of the sheet.

In the aforementioned second embodiment, the same working effects as the first embodiment are obtained. In addition, since the second discharged tray 72 is connected to the cover 73, the opening portion of the body portion 71 can be maintained to be closed even when the second discharged tray 72 is put in the second posture.

Third Embodiment

A third embodiment according to the present invention is described below. A structure of the third embodiment is almost the same as that of the first embodiment except for a structure of the second discharged tray 32. Accordingly, a structure different from the structure of the first embodiment is described in detail.

Figure 19:
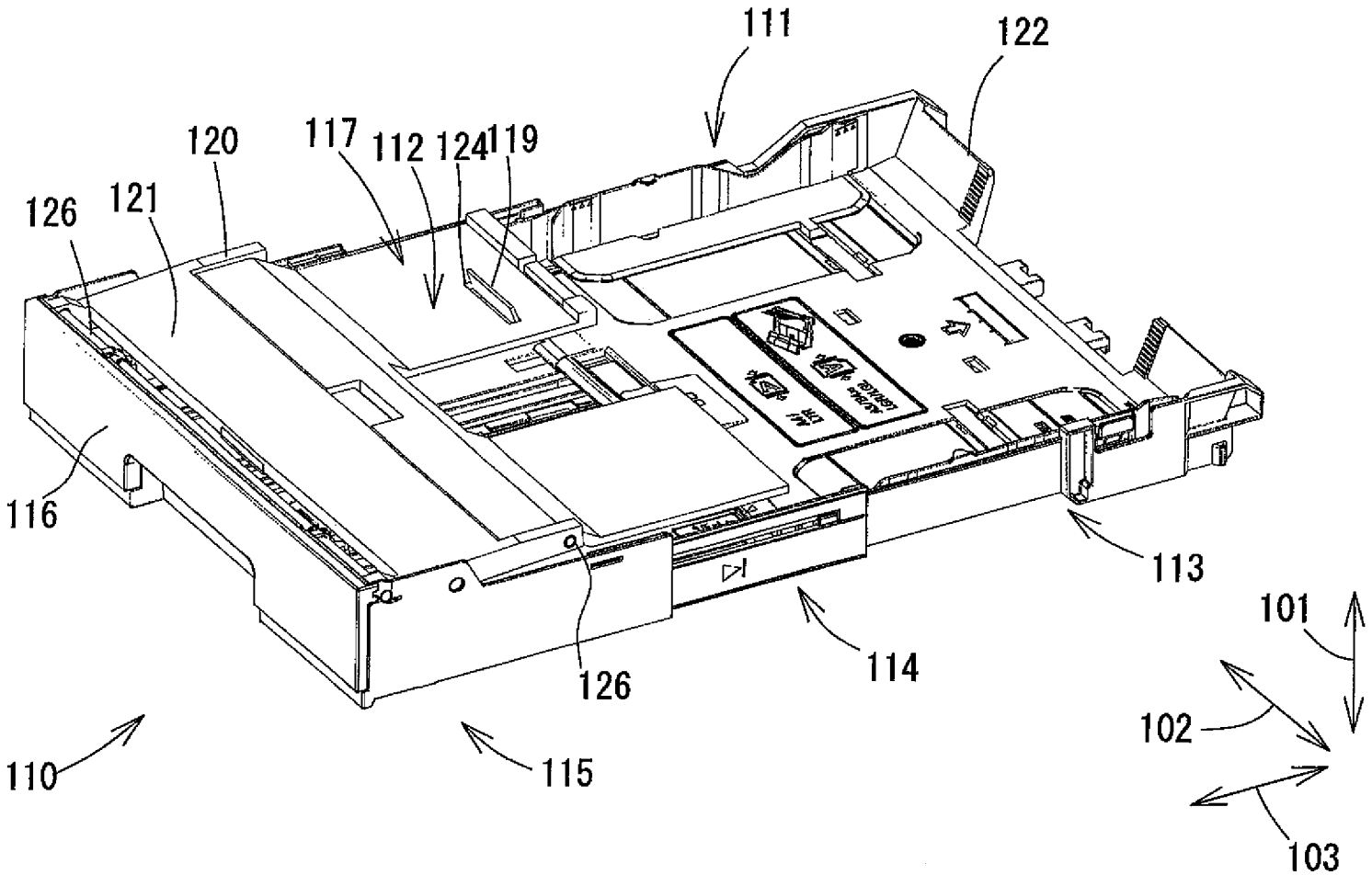
FIG. 19 is a perspective view showing an overview of a structure of a first sheet supply cassette 110 as a third embodiment according to the present invention.
Figure 20:
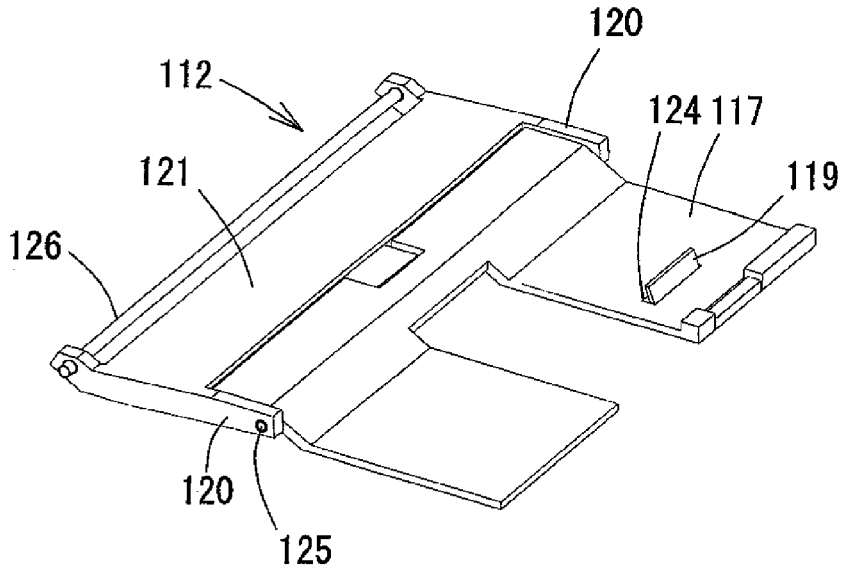
FIG. 20 is a perspective view showing a second discharged tray 72 in the first posture.

As shown in FIG. 19, the first sheet supply cassette 110 has a body portion 111 configured to accommodate the sheets, and a second discharged tray 112 provided for the body portion 111.

The body portion 111 has, like the body portion 31 of the first embodiment, a base portion 113, a first slide portion 114, and a second slide portion 115. And the body portion 111 is a plastic part like a tray showing a rectangular shape in top view and being deformable by its slide so that its size corresponds to an approximate A4 size and an approximate A3 size.

Descriptions of detail structures of these components are omitted here. The body portion 111 has a shape like a box whose upper side has an opening portion.

Figure 21:
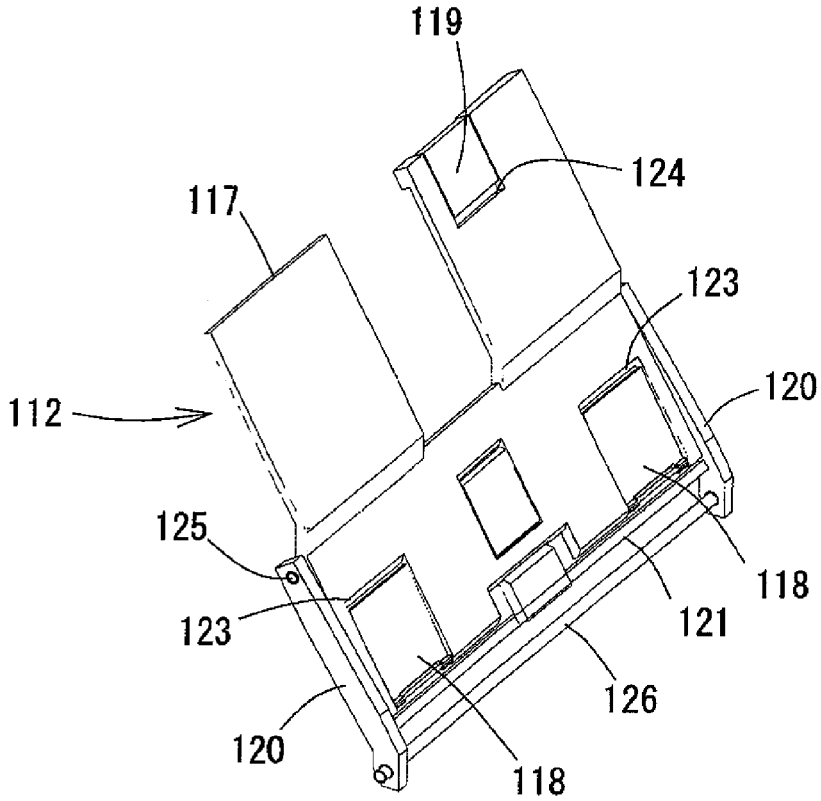
FIG. 21 is a perspective view showing the second discharged tray 72 when it is opened relative to a body portion 111.
Figure 22:
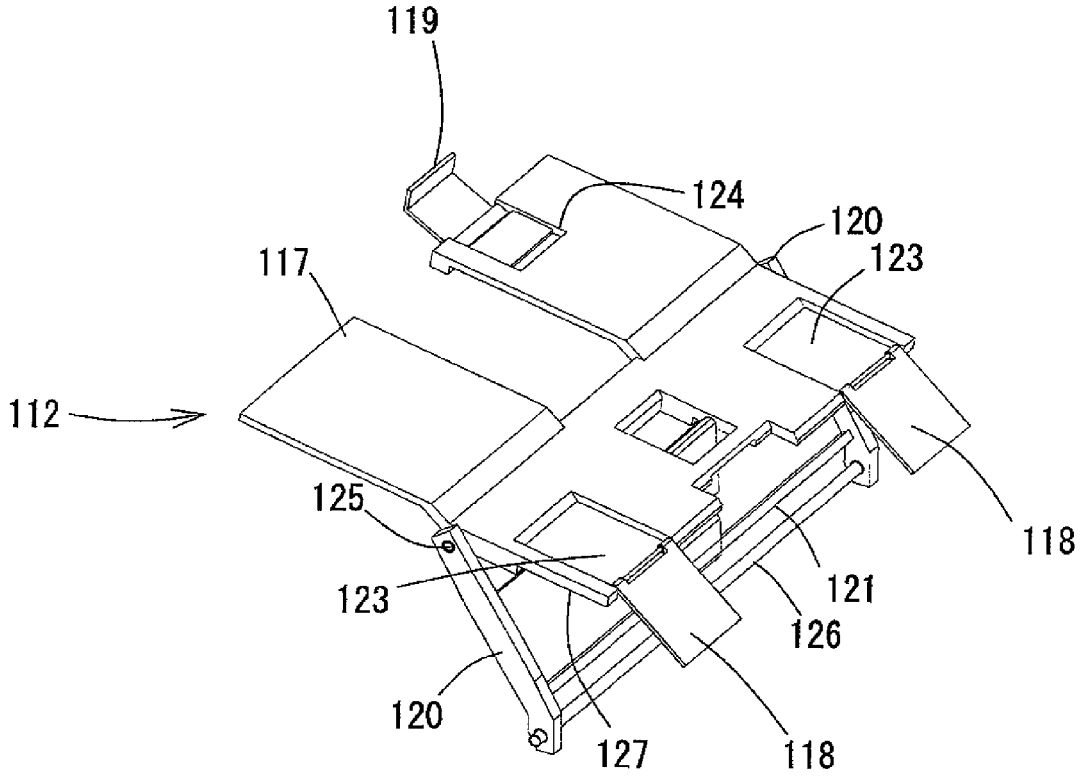
FIG. 22 is a perspective view showing a second discharged tray 112 in the second posture.

As shown in FIGS. 21 and 22, the second discharged tray 112 has a tray body 117 for supporting the sheets, guide plates 118 and a stopper 119 provided for the tray body 117, a pair of link members 120, and connection members 121 which connects the pair of link members 120 to each other. The tray body 117, the guide plate 118, and the stopper 119 is an example of a second support portion. The stopper 119 is an example of a swing member.

The tray body 117 has a structure having two stages in the front-rear direction 103, in which one of the stages placed nearer to an inclined plate 122 of the body portion 111 is positioned lower and the other of the stages placed nearer to a front face wall 116 is positioned higher, and in which the lower stage and the higher stage are continuously connected by an inclined plate. Additionally, in the tray body 117, a central portion of the lower stage in the left-right direction 102 is cut out.

A pair of guide plates 118 are provided for a front edge portion in the front-rear direction 103 of the tray body 117 in the first posture such that the guide plates 118 are allowed to swing and such that the guide plates 118 are separated away from each other in the left-right direction 102. Each of the guide plates 118 has a flat shape. On a bottom face of the tray body 117, recess portions 123 allowed to accommodate the guide plates 118 are provided. In the tray body 117 in the first posture, the guide plates 118 are folded into the recess portion 123, and, in the tray body 117 in the second posture, the guide plates 118 are swung to a posture in which the guide plates 118 protrude downward and rearward in the front-rear direction 103.

A stopper 119 is provided, for a rear edge portion in the front-rear direction 103 of the tray body 117 in the first posture such that the stopper 119 is allowed to swing. Since the central portion of the lower stage of the tray body 117 is cut out, the stopper 119 is provided for a position shifted from the central portion in the left-right direction 102. The stopper 119 may be shifted in the left or the right. The stopper 119 has a shape in which a flat plate is curved relative to the front-rear direction 103. In the tray body 117 in the first posture, the stopper 119 is swung to a first swing position (see FIGS. 19 and 21) in which it is folded on the bottom face of the tray body 117. In the first swing position, a free edge portion of the stopper 119 inserted into the through hole 124 formed in the tray body 117 so as to protrude upward from a top face of the tray body 117. Additionally, in the first posture, the stopper 119 is swung to a second swing position (see FIGS. 22 and 24) in which it protrudes forward in the front-rear direction 103 beyond the tray body 117 in the second posture. In the second swing position, the free edge portion of the stopper 119 protrudes more upward than a base edge portion of the stopper 119.

The pair of link members 120 is connected to the tray body 117 at its both sides such that the link members 120 are allowed to swing. The link members 120 are arranged such that they are separated away from each other in the left-right direction 102. Each of the link members 120 is an elongated member having an arm-shape. At both ends of each of the link members 120, shafts 125, 126 are provided. The shafts 125 are rotatably connected to the tray body 117 and the shafts 126 are rotatably connected to the side walls of the body portion 111. The link members 120 constituting the pair each of which has the arm-shape are connected to each other at their center portions by the connection member 121 which extends in the left-right direction 102. On an upper face of the front edge portion in the front-rear direction 103 of the tray body 117 in the first posture, a recess portion 127 is formed, and the connection member 121 is folded into the recess portion 127.

Figure 23:
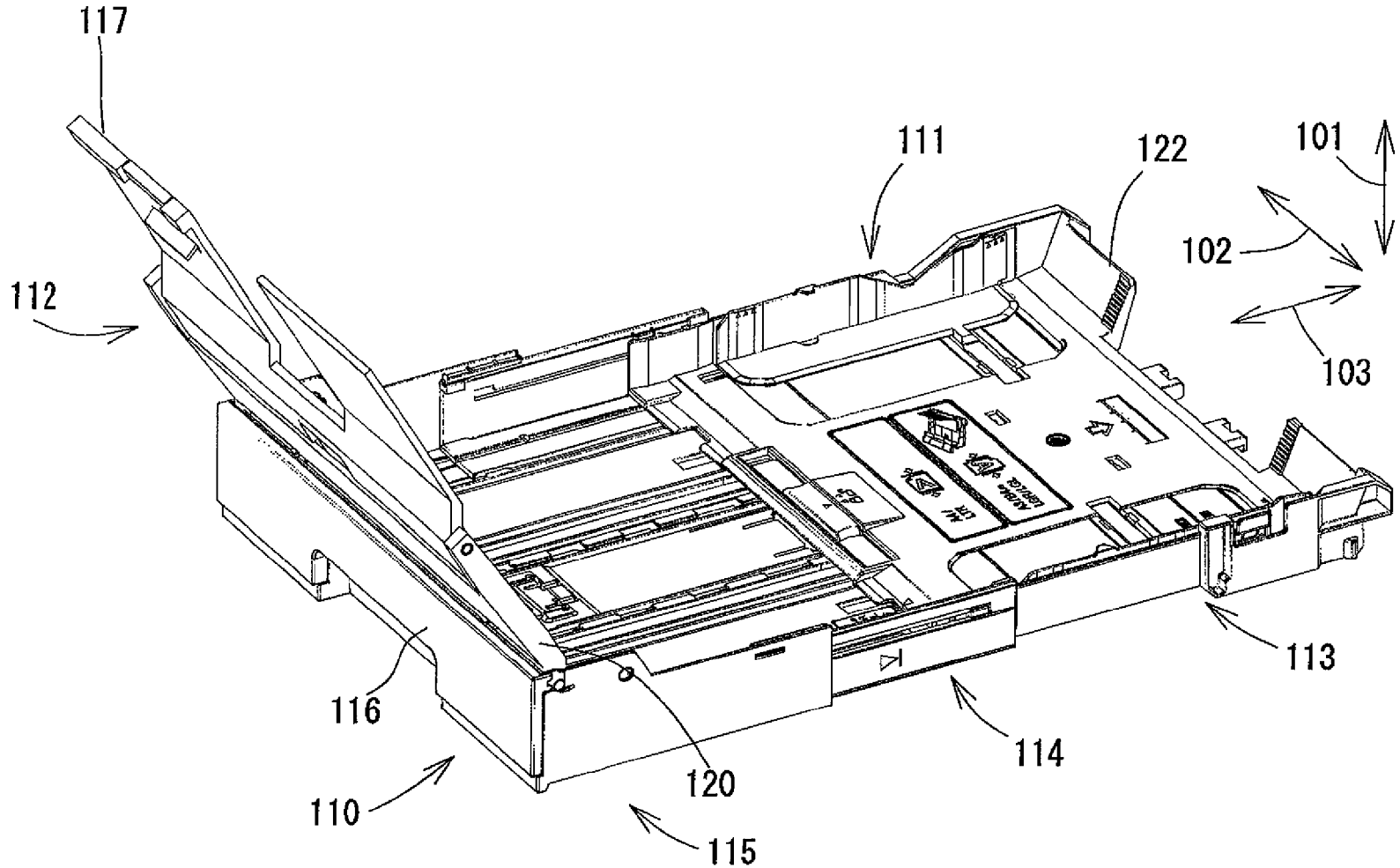
FIG. 23 is a perspective view showing an overview of a structure of the first sheet supply cassette 110 in a state in which the second discharged tray 112 has been opened relative to the body portion 111.
Figure 24:
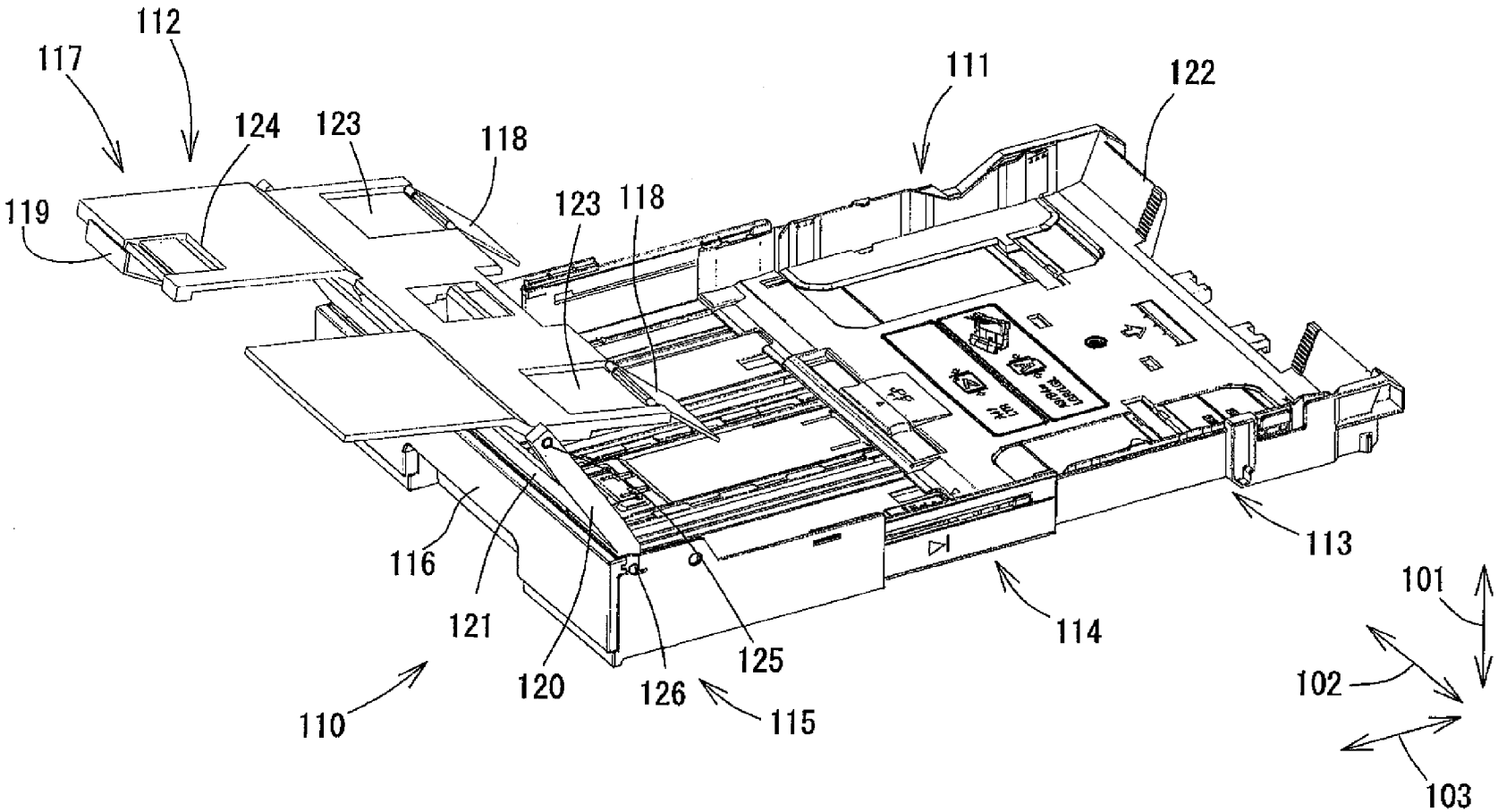
FIG. 24 is a perspective view showing the overview of the structure of the first sheet supply cassette 110 in a state in which the second discharged tray 112 is in the second posture.

As shown in FIGS. 19 and 24, the second discharged tray 112 changes its posture, by the swing of the pair of link members 120 and the swing of the second discharged tray 112 relative to the link members 120, to a first posture in which the second discharged tray 112 covers a part of an opening portion of the body portion 111 and to a second posture in which the second discharged tray 112 separates away from the opening portion of the body portion 111 and in which the second discharged tray 112 is positioned higher than in the first posture. That is, when the second discharged tray 112 is in the first posture, a position of the second discharged tray 112 is an example of a first position, and when the second discharged tray 112 is in the second posture, the position of the second discharged tray 112 is an example of a second position. Accordingly, the second discharged tray 112 is movable between the first position and the second position by the swing of the pair of link members 120 and the swing of the second discharged tray 112 relative to the link members 120. The tray body 117 of the second discharged tray 112 is supported by side walls of the cover 111, whereby the second discharged tray 112 is maintained in the first posture. As shown in FIG. 23, when the pair of link members 120 is swung to a position in which they come into abutting contact with an upper edge of the front face wall 116 of the body portion 111, the second discharged tray 112 is put in a posture in which it opens the opening portion of the body portion 111. Then, the tray body 117 is swung from this posture so that the tray body 117 is swung so as to be rear to front, and is maintained in the second posture. The upper edge portion of the front face wall 116 is an example of a contact portion.

Figure 25:
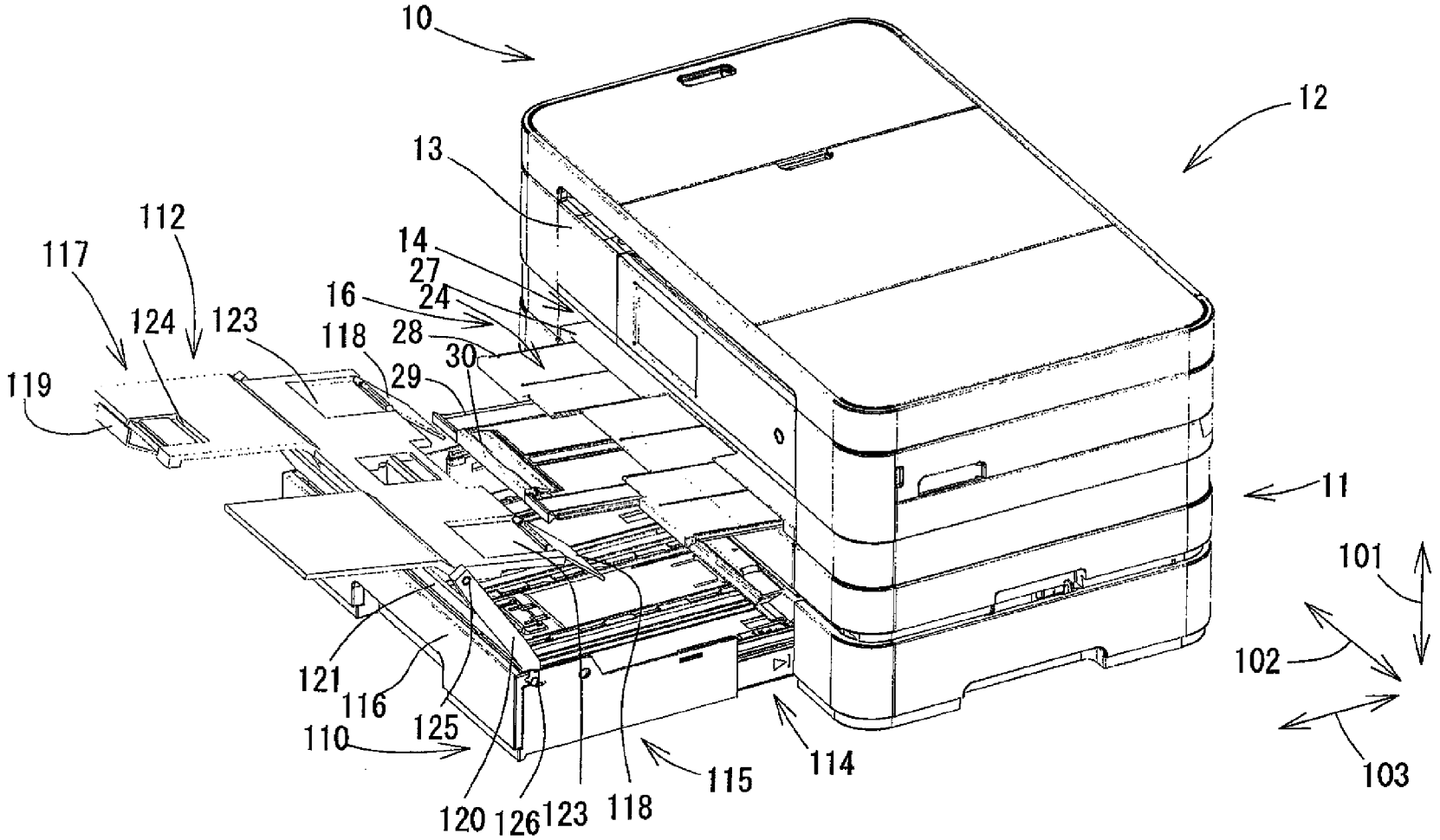
FIG. 25 is a perspective view showing the overview of the structure of the MFP 10 in a state in which the second discharged tray 112 is in the second posture.
Figure 26:
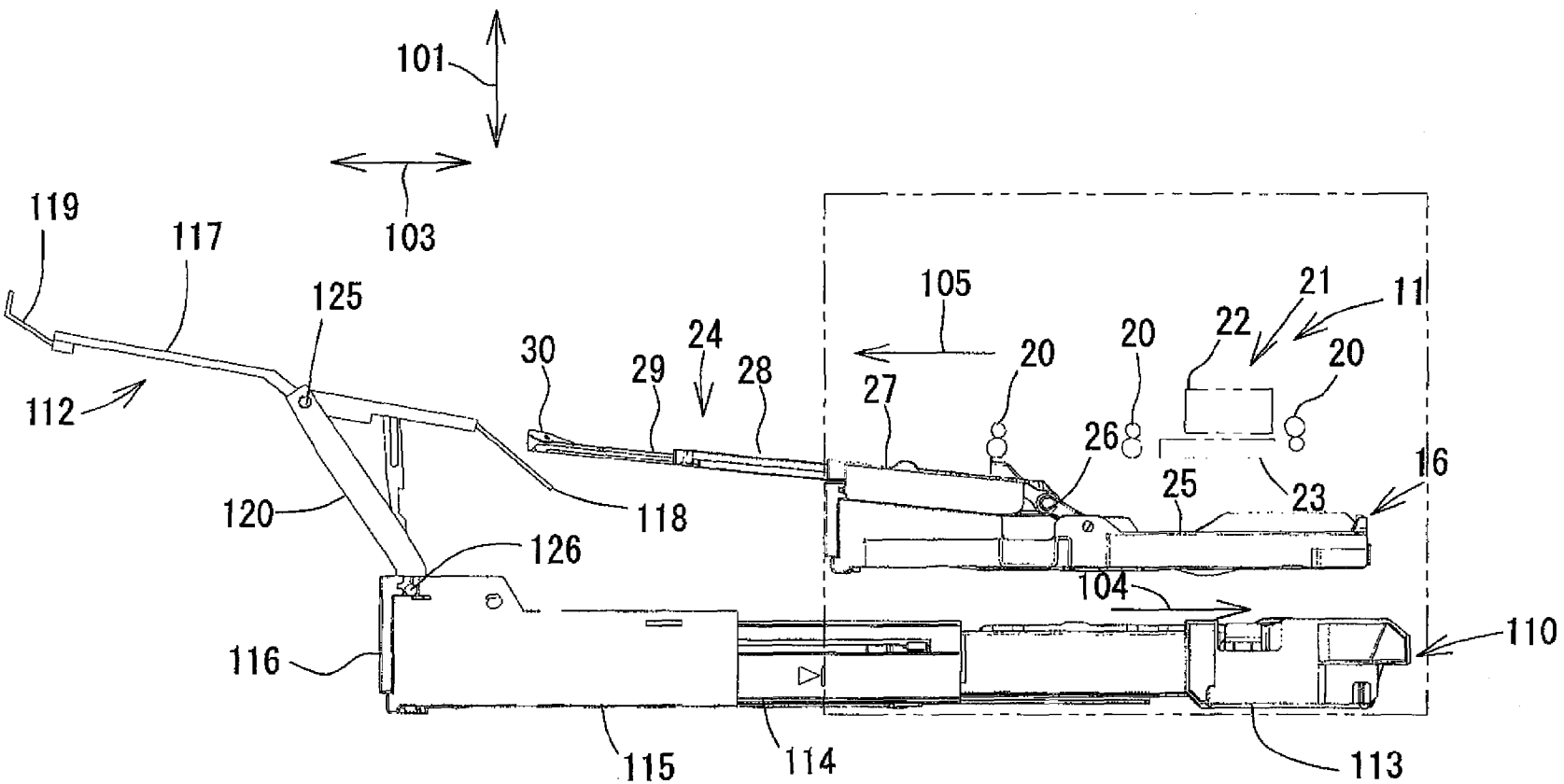
FIG. 26 is a side view showing the first sheet supply cassette 110 and the second sheet supply cassette 16 in a state in which the slide trays 28, 29 have been pulled out of the first discharged tray 24 and in which the second discharged tray 112 is in the second posture.

Like the first embodiment, when an image is recorded on the sheet of the A3 size, the slide trays 28, 29 are pulled out in the first discharged tray 24, as shown in FIGS. 25 and 26. However, the stopper 30 is maintained at the folded position. Additionally, in the body portion 111 of the first sheet supply cassette 110, the first slide portion 114 and the second slide portion 115 are pulled out from the base portion 113 so that a length of the body portion 111 in the front-rear direction 103 fits to a long side of the A3 size. Consequently, the sheet of the A3 size can be accommodated in the body portion 111. Additionally, the second slide portion 115 of the first sheet supply cassette 110 is outwardly pulled out of the inside space of the printer unit 11. The second discharged tray 112 is also outwardly pulled out of the inside space of the printer unit 11 in association with the slide of the second slide portion 115. Thus, the second sheet supply cassette 16 and so on are not positioned above the second discharged tray 112, thereby allowing the second discharged tray 112 to be swung upward. That is, the second discharged tray 112 is allowed to swing from the first posture to the second posture.

When the second discharged tray 112 is put in the second posture and the guide plate 118 is swung so as to protrude from the tray body 117, a part of the guide plate 118 is positioned in a downstream side in the discharge direction 105 of the slide trays 28, 29 of the first discharged tray 24. Additionally, a position of the downstream end in the discharge direction 105 of the tray body 117 positioned in the second posture is above the slide trays 28, 29. Moreover, in the second discharged tray 112 in the second posture, the stopper 119 is swung to the second swing position. As described above, a downstream end in the discharge direction 105 of the tray body 117 is positioned in a downstream side of a downstream end of the slide tray 29 in the discharge direction 105, and an upstream end of the guide plate 118 of the tray body 117 in the discharge direction 105 is positioned below the downstream end of the slide tray 29 in the discharge direction 105 (that is, a position of the upstream end of the guide plate 118 is lower in the up-down direction than the downstream end of the slide tray 29 in the discharge direction 105). Additionally, the position of the downstream end of the tray body 117 is higher in the up-down direction than the downstream end of the slide tray 29 in the discharge direction 105.

An image is recorded on the sheet of the A3 size in the recording portion 21, and the sheet is discharged onto the first discharged tray 24. In a state in which the slide trays 28, 29 are pulled out of the tray body 27, since the length of the first discharged tray 24 is slightly longer in the front-rear direction 103 than the length of the short side of the A4 size, the leading edge of the sheet of the A3 size passes over the first discharged tray 24.

The leading edge of the sheet having passed over the first discharged tray 24 reaches to the tray body 117 of the second discharged tray 112. In an upstream end in the discharge direction 105 of the tray body 117 in the second posture, since the guide plate 118 protrudes toward below the slide trays 28, 29, the leading edge of the sheet smoothly moves from the first discharged tray 24 to the tray body 117.

Additionally, in the tray body 117 in the second posture, since the central portion of the upstream end of the tray body 117 in the discharge direction 105 is cut out, the leading edge of the sheet fits to a shape of the tray body 117 and moves on the upper surfaces of the tray body 117 while it is bent such that the center of the leading edge of the sheet is lower than both edges of the sheet.

Then, the leading edge of the sheet moves sequentially from the tray body 117 to the sub-tray 119. Since a length between the upstream end of the first discharged tray 24 in the discharge direction 105 and a downstream end of the stopper 119 of the second discharged tray 112 in the discharge direction 105 is longer than the length of the long side of the A3 size, the sheet of the A3 size settles in a state in which it is supported by both of the first discharged tray 24 and the second discharged tray 112.

In the aforementioned third embodiment, the same working effects as the first embodiment are obtained.

Other Embodiments

Figure 27:
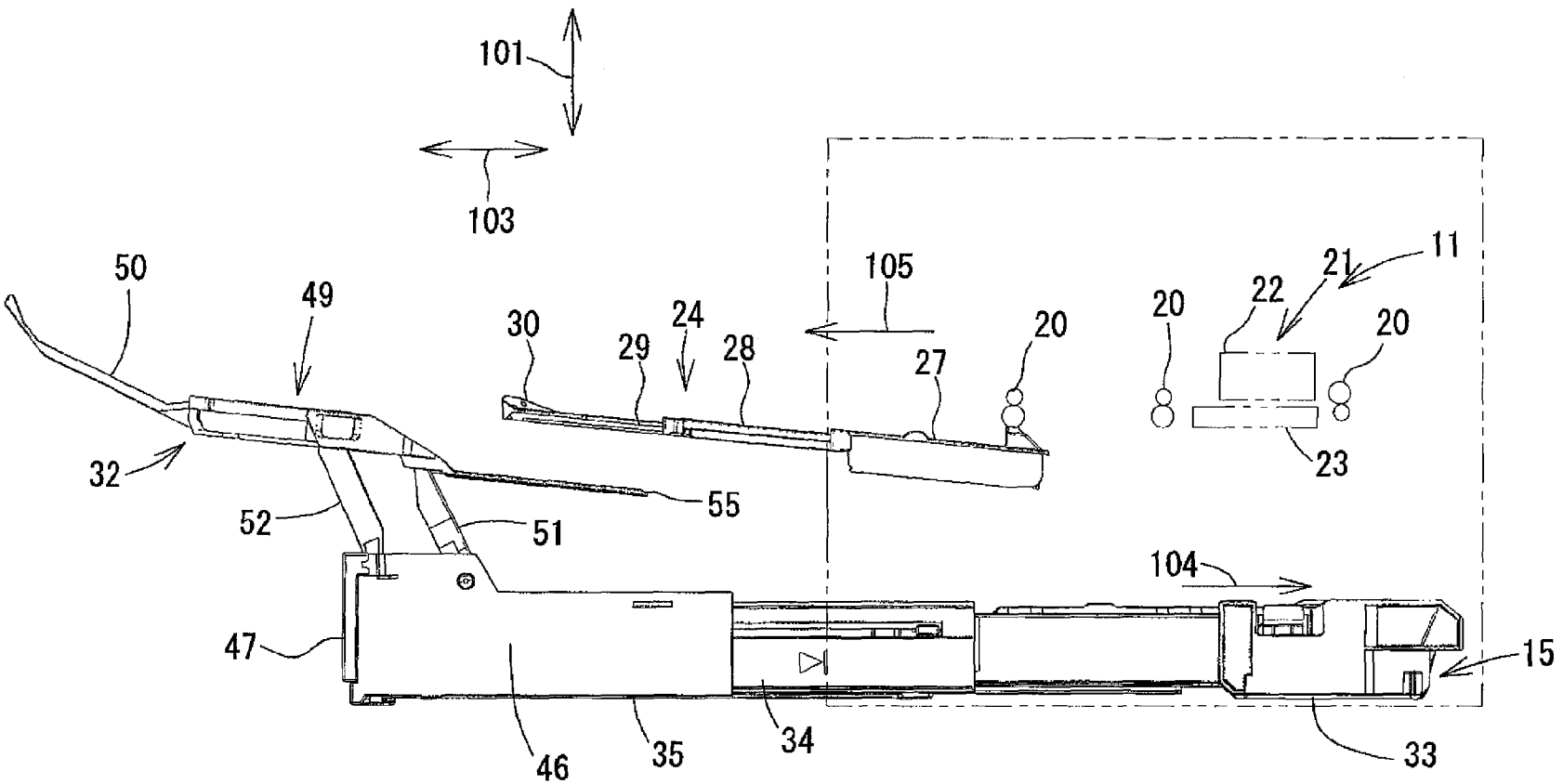
FIG. 27 is a side view showing the first sheet supply cassette 15 in a state in which the slide trays 28, 29 have been pulled out of the first discharged tray 24 and in which the second discharged tray 32 is in the second posture.

In each of the aforementioned embodiments, though two sheet supply cassettes, that is, the first sheet supply cassette 15, 70, or 110 and the second sheet supply cassette 16 are provided for the printer unit 11, the second sheet supply cassette 16 may not be necessarily provided for the printer unit 11. For example, as shown in FIG. 27, the first discharged tray 24 may be provided for independently in the inside space of the printer unit 11, and only the first sheet supply cassette 15 may be provided as the sheet supply cassette. In such an embodiment, the second discharged tray 32 provided for the first sheet supply cassette 15 can be changed in its posture to the first posture and to the second posture, whereby the same working effects as the first embodiment are obtained.

Additionally, in each of the aforementioned embodiments, each of the second discharged trays 32, 72, 112 has a structure in which the second discharged tray 32, 72, or 112 swings relative to the corresponding body portion 31, 71, or 111 of the sheet supply cassette 15, 70, or 110, whereby the posture of the second discharged tray 32, 72, or 112 is changed to the first posture and to the second posture. However the change of the posture to the first posture and the second posture may be realized by a motion other than the swing. For example, in the first embodiment, the present invention may be realized by a structure in which the second discharged tray 32 may be slidably provided so as to protrude obliquely upward from the body portion 31 by being pulled out of the body portion 31, thereby allowing the change of the posture from the first posture to the second posture.

What is claimed is:

1. An image recording apparatus, comprising:

an accommodation portion configured to accommodate a sheet;

a supply mechanism configured to supply the sheet from the accommodation portion;

a recording portion configured to record an image on the sheet supplied by the supply mechanism; and a first discharged tray which is above the accommodation portion, and is configured to support the sheet on which the image had been recorded by the recording portion, wherein the accommodation portion includes:

a body portion configured to accommodate the sheet; and a second discharged tray provided for the body portion and configured to be positioned in a first position and a second position, the second discharged tray in the second position being higher than the second discharged tray in the first position, and configured to support the sheet on which the image had been recorded, together with the first discharged tray.

2. The image recording apparatus according to claim 1, wherein the first discharged tray comprises a first support portion configured to support the sheet, wherein the second discharged tray comprises a second support portion configured to support the sheet, wherein at least a part of the second support portion of the second discharged tray in the second position is in a downstream side of the first support portion in a discharge direction in which the sheet is discharged, and wherein an upstream end of the second support portion in the discharge direction of the second discharged tray in the second position is below the first support portion, and a downstream end of the second support portion in the discharge direction of the second discharged tray in the second position is above the first support portion.

3. The image recording apparatus according to claim 1, wherein the body portion of the accommodation portion comprises a base portion, and a slide portion slidable relative to the base portion in a discharge direction in which the sheet is discharged, and wherein the second discharged tray is provided for the slide portion.

4. The image recording apparatus according to claim 1, wherein the accommodation portion is accommodated in a main body of the image recording apparatus and the second discharged tray is configured to be pulled out of the main body of the image recording apparatus, and wherein the second discharged tray is configured to be positioned in the second position in a state in which the second discharged tray has been pulled out of the main body of the image recording apparatus.

5. The image recording apparatus according to claim 1, wherein the second discharged tray in the first position is above the body portion.

6. The image recording apparatus according to claim 1, wherein the second discharged tray is connected to the body portion by at least one link member swingable relative to the second discharged tray, such that the second discharged tray is allowed to move relative to the body portion.

7. The image recording apparatus according to claim 6,
wherein the second discharged tray is configured to move relative to the body portion by four link members as the at least one link member,
wherein the four link members are constituted by two pairs of link members each pair of which is constituted by two of the four link members arranged in a width direction perpendicular to the discharge direction in which the sheet is discharged, and
wherein the four link members are arranged in different positions from each other in the width direction.

8. The image recording apparatus according to claim 7,
wherein the link members constituting the pair of link members are connected to each other by a connection member.

9. The image recording apparatus according to claim 7,
wherein the accommodation portion comprises a contact portion which comes into an abutting contact with at least one of the four link members so as to maintain the at least one of the four link members in at least one swing position of the at least one of the four link members that is a position in which the second discharged tray is put in the second position.

10. The image recording apparatus according to claim 1,
wherein an upper accommodation portion configured to accommodate the sheet is arranged above the accommodation portion and below the first discharged tray, and
wherein the first discharged tray is provided for the upper accommodation portion.

11. The image recording apparatus according to claim 1,
wherein the body portion comprises an opening portion which is open upwardly, and
wherein the second discharged tray in the first position closes at least a part of the opening portion of the body portion.

12. The image recording apparatus according to claim 1,
wherein the body portion comprises an opening portion which is open upwardly,
wherein the accommodation portion comprises a cover configured to close at least a part of the opening portion of the body portion, and
wherein the second discharged tray is connected to the cover.

13. The image recording apparatus according to claim 1,
wherein a central portion of the second discharged tray is positioned lower than both of end portions of the second discharged tray in a width direction perpendicular to the discharge direction in which the sheet is discharged.

14. The image recording apparatus according to claim 1,
wherein the image recording apparatus further comprises a swing member which is provided for the second discharged tray such that the swing member is allowed to swing, and which is configured to change its position to a first swing position in which the swing member is accommodated in the second discharged tray and to a second swing position in which the swing member protrudes from the second discharged tray.

15. An image recording apparatus, comprising:
an accommodation portion configured to accommodate a sheet;
an upper accommodation portion which is arranged above the accommodation portion and is configured to accommodate the sheet;
a supply mechanism configured to supply the sheet from the accommodation portion;
a recording portion configured to record an image on the sheet supplied by the supply mechanism; and
a first discharged tray which is above the upper accommodation portion, and is configured to support the sheet on which the image had been recorded by the recording portion,
wherein the upper accommodation portion is prohibited to slide in a discharge direction in which the sheet is discharged, and
wherein the accommodation portion includes:
a body portion configured to accommodate the sheet;
a slide portion configured to slide relative to the body portion in the discharge direction; and
a second discharged tray provided for the slide portion and configured to be positioned in a first position and a second position, the second discharged tray in the second position being higher than the second discharged tray in the first position, and configured to support the sheet on which the image had been recorded, together with the first discharged tray.

* * * * *